US007975335B2

(12) United States Patent
O'Keefe et al.

(10) Patent No.: US 7,975,335 B2
(45) Date of Patent: Jul. 12, 2011

(54) PULMONARY MATTRESS

(75) Inventors: Christopher R. O'Keefe, Batesville, IN (US); Bradley T. Wilson, Batesville, IN (US); Sandy M. Richards, Pershing, IN (US); Eric R. Meyer, Greensburg, IN (US)

(73) Assignee: Hill-Rom Services, Inc., Batesville (IN)

( * ) Notice: Subject to any disclaimer, the term of this patent is extended or adjusted under 35 U.S.C. 154(b) by 43 days.

(21) Appl. No.: 11/745,694

(22) Filed: May 8, 2007

(65) Prior Publication Data

US 2007/0266499 A1 Nov. 22, 2007

Related U.S. Application Data

(60) Provisional application No. 60/799,435, filed on May 9, 2006.

(51) Int. Cl.
*A47C 21/08* (2006.01)

(52) U.S. Cl. ..... 5/616; 5/724

(58) Field of Classification Search ..... 5/600, 607, 5/609, 710, 713, 616, 724
See application file for complete search history.

(56) References Cited

U.S. PATENT DOCUMENTS

| | | | |
|---|---|---|---|
| 1,772,310 | A | 8/1930 | Hart |
| 3,340,550 | A | 9/1967 | Hopkins et al. |
| 3,340,551 | A | 9/1967 | Hopkins |
| 3,354,476 | A | 11/1967 | Scales et al. |
| 3,428,973 | A | 2/1969 | Hargest et al. |
| 3,434,165 | A | 3/1969 | Keane |
| 3,492,988 | A | 2/1970 | De Mare |
| 3,644,950 | A | 2/1972 | Lindsay, Jr. |
| 3,674,019 | A | 7/1972 | Grant |
| 3,757,366 | A | 9/1973 | Sacher |
| 3,778,851 | A | 12/1973 | Howorth |
| 3,822,425 | A | 7/1974 | Scales |
| 3,867,732 | A | 2/1975 | Morrell |
| 4,193,149 | A | 3/1980 | Welch |
| 4,224,706 | A | 9/1980 | Young et al. |
| 4,347,633 | A | 9/1982 | Gammons et al. |
| 4,357,722 | A | 11/1982 | Thompson |
| 4,391,009 | A | 7/1983 | Schild et al. |
| 4,394,784 | A | 7/1983 | Swenson et al. |
| 4,411,035 | A | 10/1983 | Fenwick |

(Continued)

FOREIGN PATENT DOCUMENTS

GB 932779 7/1963

(Continued)

OTHER PUBLICATIONS

"The Pillo-Pump® Alternating Pressure System," Gaymar Industries, Inc., advertising brochures, two pages, date 1986.
"Grant Dyna-Care," Grant advertising literature, two pages, date unknown.
"ALAMO-Alternating Low Airloss Mattress Overlay," National Patient Care Systems, Inc., advertising literature, two pages, date unknown.

(Continued)

*Primary Examiner* — Shane Bomar
*Assistant Examiner* — Gilbert Y Lee
(74) *Attorney, Agent, or Firm* — Barnes & Thornburg LLP

(57) ABSTRACT

A patient-support apparatus includes a mattress assembly supported on a frame, the mattress assembly including a coverlet configured to provide low-airloss therapy to a patient supported on the patient-support apparatus. The patient-support apparatus is articulable to a number of positions and includes a control network which is responsive to movement of portions of the frame to alter operational parameters of the frame and mattress assembly.

23 Claims, 20 Drawing Sheets

U.S. PATENT DOCUMENTS 4,435,864 A 3/1984 Callaway
4,483,030 A 11/1984 Flick et al.
4,525,409 A 6/1985 Elesh
4,525,885 A 7/1985 Hunt et al.
4,628,557 A 12/1986 Murphy
4,638,519 A 1/1987 Hess
4,803,744 A 2/1989 Peck et al.
4,862,529 A 9/1989 Peck
4,897,890 A 2/1990 Walker
4,944,060 A 7/1990 Perry et al.
4,951,335 A 8/1990 Eady
4,970,743 A 11/1990 Wride et al.
4,977,633 A 12/1990 Chaffee
4,982,466 A 1/1991 Higgins et al.
4,986,738 A 1/1991 Kawasaki et al.
4,991,244 A 2/1991 Walker
4,993,920 A 2/1991 Harkleroad et al.
4,999,867 A 3/1991 Toivio et al.
5,003,654 A 4/1991 Vrzalik
5,005,240 A 4/1991 Vrzalik
5,007,123 A 4/1991 Salyards
5,010,608 A 4/1991 Barnett et al.
5,018,786 A 5/1991 Goldstein et al.
5,022,110 A 6/1991 Stroh
5,023,967 A 6/1991 Ferrand
5,044,029 A 9/1991 Vrzalik
5,044,364 A 9/1991 Crowther
5,052,068 A 10/1991 Graebe
5,060,174 A 10/1991 Gross
5,062,169 A 11/1991 Kennedy et al.
5,068,933 A 12/1991 Sexton
5,083,335 A 1/1992 Krouskop et al.
5,095,568 A 3/1992 Thomas et al.
5,103,519 A 4/1992 Hasty
5,129,117 A 7/1992 Celestina et al.
5,142,719 A 9/1992 Vrzalik
5,152,021 A 10/1992 Vzralik
5,157,800 A 10/1992 Borders
5,170,364 A 12/1992 Gross et al.
5,179,742 A 1/1993 Oberle
5,216,768 A 6/1993 Bodine et al.
5,251,349 A 10/1993 Thomas et al.
5,267,364 A 12/1993 Volk
5,269,030 A 12/1993 Pahno et al.
5,279,010 A 1/1994 Ferrand et al.
5,325,551 A 7/1994 Tappel et al.
5,331,698 A 7/1994 Newkirk et al.
5,335,384 A 8/1994 Foster et al.
5,367,728 A 11/1994 Chang
5,370,439 A 12/1994 Lowe et al.
5,375,273 A 12/1994 Bodine, Jr. et al.
5,438,721 A 8/1995 Pahno et al.
5,454,126 A 10/1995 Foster et al.
5,479,666 A 1/1996 Foster et al.
5,483,709 A 1/1996 Foster et al.
5,487,196 A 1/1996 Wilkinson et al.
5,493,742 A 2/1996 Klearman
5,509,155 A 4/1996 Zigarac et al.
5,513,406 A 5/1996 Foster et al.
5,539,943 A 7/1996 Romano
5,542,136 A 8/1996 Tappel
5,560,057 A 10/1996 Madsen et al.
5,586,346 A 12/1996 Stacy et al.
5,603,133 A 2/1997 Vrzalik
5,606,754 A 3/1997 Hand et al.
5,611,096 A 3/1997 Bartlett et al.
5,630,238 A 5/1997 Weismiller et al.
5,647,079 A 7/1997 Hakamiun et al.
5,664,270 A 9/1997 Bell et al.
5,666,681 A 9/1997 Meyer et al.
5,687,438 A 11/1997 Biggie et al.
5,699,570 A 12/1997 Wilkinson et al.
5,715,548 A * 2/1998 Weismiller et al. ..... 5/624
5,729,853 A 3/1998 Thompson
5,755,000 A 5/1998 Thompson
5,781,949 A 7/1998 Weismiller et al.
5,787,534 A 8/1998 Hargest et al.
5,815,864 A 10/1998 Sloop
5,870,785 A 2/1999 Hoorens
5,882,349 A * 3/1999 Wilkerson et al. ..... 604/289
5,887,304 A 3/1999 von der Heyde
5,904,172 A 5/1999 Gifft et al.
5,926,884 A 7/1999 Biggie et al.
5,983,429 A 11/1999 Stacy et al.
6,012,186 A 1/2000 Soltani et al.
6,021,533 A 2/2000 Ellis et al.
6,047,424 A 4/2000 Osborne et al.
6,062,215 A 5/2000 Leininger et al.
6,073,291 A 6/2000 Davis
6,079,090 A 6/2000 Ongaro
6,085,372 A 7/2000 James et al.
6,115,860 A 9/2000 Vrzalik
6,119,291 A 9/2000 Osborne et al.
6,145,142 A 11/2000 Rechin et al.
6,148,461 A 11/2000 Cook et al.
6,163,903 A 12/2000 Weismiller et al.
6,282,737 B1 9/2001 Vrzalik
6,339,410 B1 1/2002 Milner et al.
6,421,859 B1 * 7/2002 Hicks et al. ..... 5/722
6,499,167 B1 12/2002 Ellis et al.
6,536,056 B1 3/2003 Vrzalik et al.
6,584,628 B1 * 7/2003 Kummer et al. ..... 5/615
6,698,046 B1 3/2004 Wu
6,708,352 B2 3/2004 Salvatini et al.
6,730,115 B1 5/2004 Heaton
6,735,799 B1 5/2004 Ellis et al.
6,745,996 B1 6/2004 Guthrie
6,782,574 B2 8/2004 Totton et al.
6,855,158 B2 2/2005 Stolpmann
6,892,405 B1 5/2005 Dimitriu et al.
6,942,687 B1 9/2005 Heaton et al.
6,953,439 B1 10/2005 Kabemba
7,036,171 B2 5/2006 Wu
7,086,107 B2 8/2006 Ellis et al.
7,171,711 B2 2/2007 Gowda
7,216,389 B2 5/2007 Ellis et al.
7,260,860 B2 8/2007 Chambers et al.
7,296,315 B2 11/2007 Totton et al.
2001/0033925 A1 * 10/2001 Trapp et al. ..... 428/311.51
2006/0019581 A1 1/2006 Zhang et al.
2006/0101581 A1 5/2006 Blanchard et al.
2007/0050910 A1 3/2007 Blanchard et al.
2007/0157385 A1 7/2007 Lemire et al.
2007/0163043 A1 7/2007 Lemire et al.
2007/0169268 A1 7/2007 Lemire et al.
2007/0174964 A1 8/2007 Lemire et al.
2007/0174965 A1 8/2007 Lemire et al.

FOREIGN PATENT DOCUMENTS

GB 1545806 5/1979
GB 2134379 8/1984
WO 9427544 12/1994
WO 9909865 3/1999

OTHER PUBLICATIONS

"Sof-Care Plus® Long Term Bed Cushion," Gaymar Industries, Inc., advertising literature, two pages, 1985.
"Airflo by Gaymar, Alternating Pressure Rellief System," Gaymar Industries, Inc., advertising literature, two pages, date unknown.
"Airflow Plus," Gaymar Industries, Inc. advertising literature, two pages, 1988.
"Using Sof-Care® just got easier . . . ," Gaymar Industries, Inc., advertising literature, four pages, 1992.
"The System That Continues to Set the Standard . . . To Supply You With Proven Benefits," Gaymar Industries, Inc., advertising literature, Pillo Pad™, three pages, date unknown.
"A Pressure Relief Device Based on Fact, Not Fiction . . . Take a Closer Look . . . ," Gaymar Industries, Inc. advertising literature, Sof-Care®, three pages, Nov. 1988.
International Search Report based on PCT/US2007/011122 completed Aug. 8, 2008.

* cited by examiner

PULMONARY MATTRESS

This application claims the benefit, under 35 U.S.C. §119 (e), of U.S. Provisional Patent Application Ser. No. 60/799,435 filed May 9, 2006 which is hereby incorporated by reference herein in its entirety.

BACKGROUND OF THE INVENTION

The present disclosure is related to a patient-support apparatus. More specifically, the present disclosure is related to a patient-support apparatus configured to support a patient with pulmonary complications.

Bariatrics is the area of medicine related to the management of obesity and diseases and clinical conditions related to obesity. In care environments, such as hospitals, for example, obese patients present special issues related to their care. For example, standard patient handling equipment is not typically sized or rated to support obese patients. In addition, patient therapy devices are not typically sized to fit obese patients. Those patient therapy devices which are sized to fit obese patients may not be configured to provide effective therapy to patients.

Persons who are confined to a patient-support apparatus, such as a hospital bed, for example, for extended periods run the risk of developing pulmonary complications. They are particularly susceptible to nosocomial infections such as pneumonia or bronchial infections. For persons confined to a patient-support apparatus for an extended time, pulmonary therapy may be provided to reduce the risk of pulmonary complications. For example, continuous lateral rotation, percussion therapy, or vibration therapy each reduce the risk of development of pulmonary complications such as nosocomial infections.

SUMMARY OF THE INVENTION

The present disclosure comprises one or more of the features recited in the appended claims and/or the following features which, alone or in any combination, may comprise patentable subject matter:

According to the present disclosure, a patient-support apparatus illustratively embodied as a hospital bed includes an upper frame, an upper deck supported on the upper frame, and a controller operable to control movement of the upper frame and the upper deck. The upper frame includes a head end and a foot end and is movable between a generally horizontal position and a position wherein the head end of the upper frame is spaced vertically below the foot end of the upper frame. The upper deck is supported on and movable with the upper frame. The upper deck includes a seat section and a head section pivotable relative to the seat section to change the angular relationship between the head section and the seat section.

The controller is configured to coordinate movement of the upper frame and the head section of the upper deck such that with movement of the head section of the upper deck from a position in which the head section is generally coplanar with the seat section to a position in which the head section is inclined, the controller causes the upper frame to move from the generally horizontal position to a first position wherein the upper frame deviates from horizontal by a first angle. Continued articulation of the head section upwardly causes the upper frame to move from the first angle back to the generally horizontal position. In some embodiments, the controller is in communication with a peer-to-peer network. The angular displacement of the upper frame may be measured by at least one potentiometer. Similarly, the angular position of the head section may be measured by at least one potentiometer.

In some embodiments, the patient-support apparatus may further comprise a first inflatable structure positioned on the seat section and configured to support a portion of a patient. When the first inflatable structure is present, articulation of the head section may cause the inflatable structure to deflate. The first inflatable structure may continue to deflate during the entire range of articulation of the head section. In some embodiments, after a portion of travel of the head section, the first inflatable structure may begin to re-inflate.

In some embodiments, the patient-support apparatus may further comprise a second inflatable structure supported on the first inflatable structure. When both the first and second inflatable structures are present, the first inflatable structure may deflate in response to articulation of the head section and the second inflatable structure may maintain inflation. The second inflatable structure may operate at an increased pressure to tend to prevent bottoming out of a patient supported on the patient-support apparatus against the seat section.

The upper frame may deviate from a generally horizontal position to an inclined position of about (15°). The head section may articulate to an inclined angle of about (65°).

In some embodiments where first and second inflatable structures are present, the first inflatable structure may be operable to provide continuous lateral rotation therapy to a patient on the patient-support apparatus. Operation of the inflatable structures may be controlled by a pneumatic supply and control system. The pneumatic supply and control system may be coupled to the peer-to-peer network.

The patient-support apparatus may further comprise a mattress and the inflatable structures may be included within the mattress. The mattress may be configured to provide low-airloss therapy to a patient supported on the mattress. The mattress may include a coverlet removably coupled to the mattress, the coverlet configured to provide the low-airloss therapy. The coverlet may comprise an upper portion including (i) a vapor permeable, air impermeable, water resistant top layer of fabric, (ii) a vapor permeable, air impermeable, water resistant bottom layer, and (iii) a spacer fabric interposed between the top and bottom layers to facilitate air flow through the coverlet. The coverlet may include a plurality of inlets at a foot end of the coverlet. The coverlet may also include an outlet at a head end of the coverlet.

In some embodiments, the first inflatable structure may be positioned on the upper deck, a second inflatable structure may be supported on the first inflatable structure, and a third inflatable structure may be supported on the second inflatable structure the third inflatable structure may include a plurality of air chambers which may be selectively and alternatively rapidly inflated to impart a percussion and/or vibration to a portion of the body of a patient. The third inflatable structure may be positioned to engage the chest of a patient supported thereon. A coverlet may be positioned above the first, second, and third inflatable structures. The coverlet may be configured to receive pressurized air to provide low-airloss therapy to a patient supported thereon.

The low-airloss therapy may be controlled by a low-airloss control module configured to be removably coupled to the pneumatic supply and control system to control the operation of the coverlet. The low-airloss control module may include (i) a controller electrically communicating with the pneumatic supply and control system, (ii) a plurality of connectors configured to engage the pneumatic supply and control system to receive pressurized air, (iii) an electrical connector, (iv) a plurality of outputs configured to provide pneumatic communication between the low-airloss module and the coverlet, and (v) a plurality of valves responsive to the controller to control a flow of pressurized air from the pneumatic supply and control system to the coverlet. The electrical connector may be configured to engage the pneumatic supply and control system to provide electrical communication between the controller and the pneumatic supply and control system.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
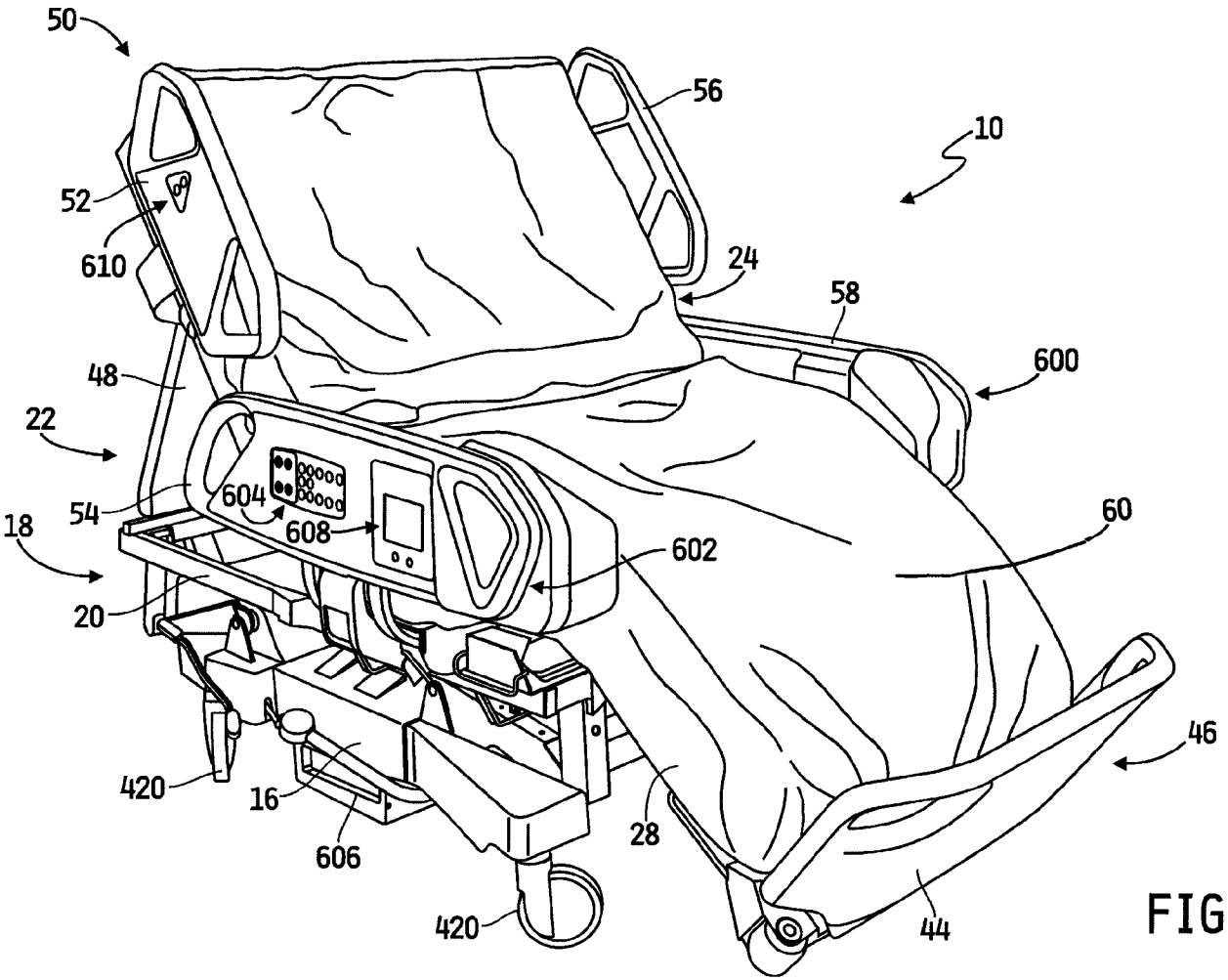
FIG. 1 is a perspective view of a patient-support apparatus of the present disclosure, the patient-support apparatus positioned in a chair position.
Figure 3:
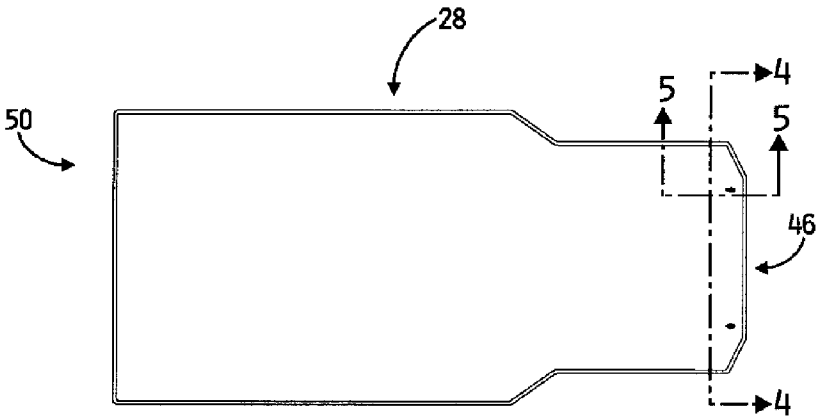
FIG. 3 is a top view of the coverlet of FIG. 2.
Figure 5:
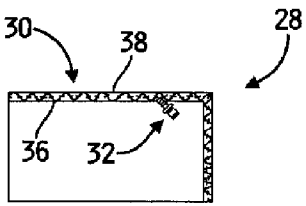
FIG. 5 is a cross-sectional view of the coverlet of FIG. 2 taken along the lines 5-5 in FIG. 3.
Figure 4:
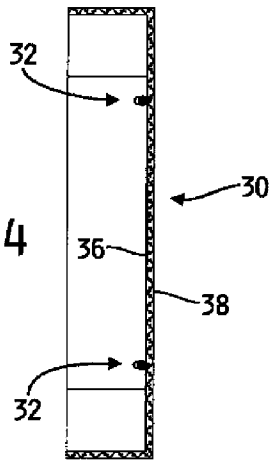
FIG. 4 is a cross-sectional view of the coverlet of FIG. 2 taken along the lines 4-4 in FIG. 3.
Figure 2:
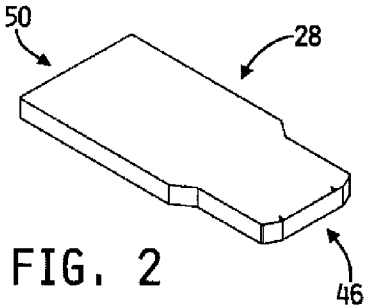
FIG. 2 is a perspective view of a coverlet of a mattress assembly positioned on the patient-support apparatus of FIG. 1, the coverlet including an upper portion configured to distribute pressurized air throughout the upper portion.

A patient-support apparatus illustratively embodied as a hospital bed 10 includes a frame 12 (see FIGS. 19A and 19B) and a mattress assembly 14 (see FIG. 16) coupled to the frame. Illustratively, mattress assembly 14 is a patient-support surface integrated with the frame 12 and including foam components and a plurality of inflatable structures which are separately inflatable to provide therapy and support to a patient supported on the mattress assembly 14. It is within the scope of this disclosure for the patient-support apparatus to support patients of up to 1000 pounds or more. To accommodate patients of varied sizes, the patient-support apparatus may have a width of up to 50 inches or more. Thicknesses of inflatable structures such as air cells, bladders, tubes, etc., as discussed herein, may be formed of conventional thicknesses or have a thickness thicker than conventional thicknesses to support bariatric patients up to 1000 pounds (453.6 kg) or more.

Frame 12 includes a base 16, a lift system 18, an upper frame 20, and an upper deck 22. As will be discussed in more detail below, the deck is articulable to any of a number of configurations to support a patient positioned on the mattress assembly 14 for comfort or therapeutic purposes.

Figure 6:
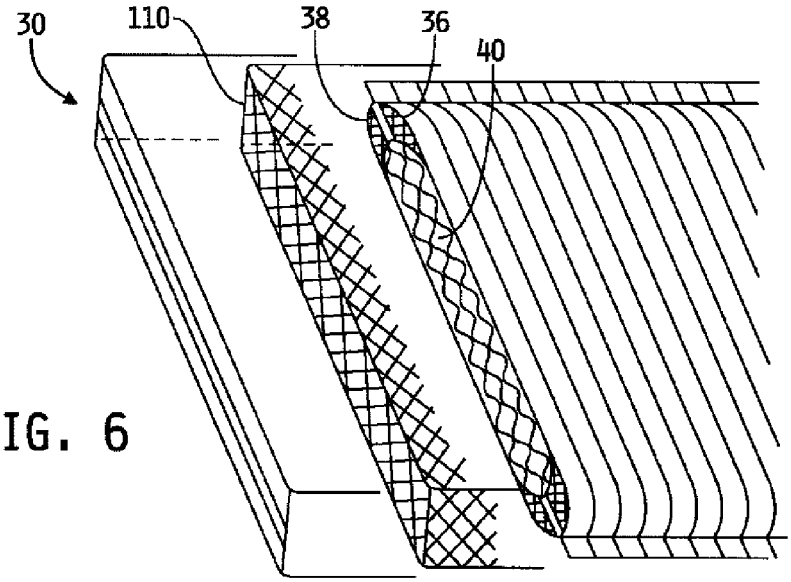
FIG. 6 is a diagrammatic depiction of the structure of the upper portion of the coverlet of FIG. 2.
Figure 7:
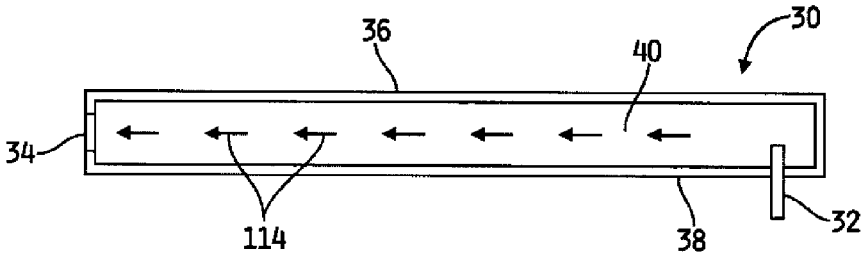
FIG. 7 is a diagrammatic side view of the upper portion of the coverlet of FIG. 2 depicting the flow of air through the upper portion.
Figure 8:
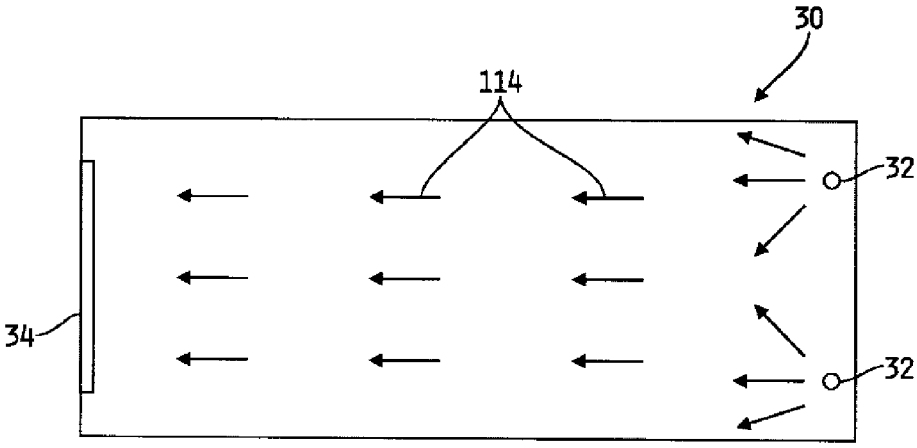
FIG. 8 is a diagrammatic top view of the upper portion of the coverlet of FIG. 2 depicting the flow of air through the coverlet.
Figure 9:
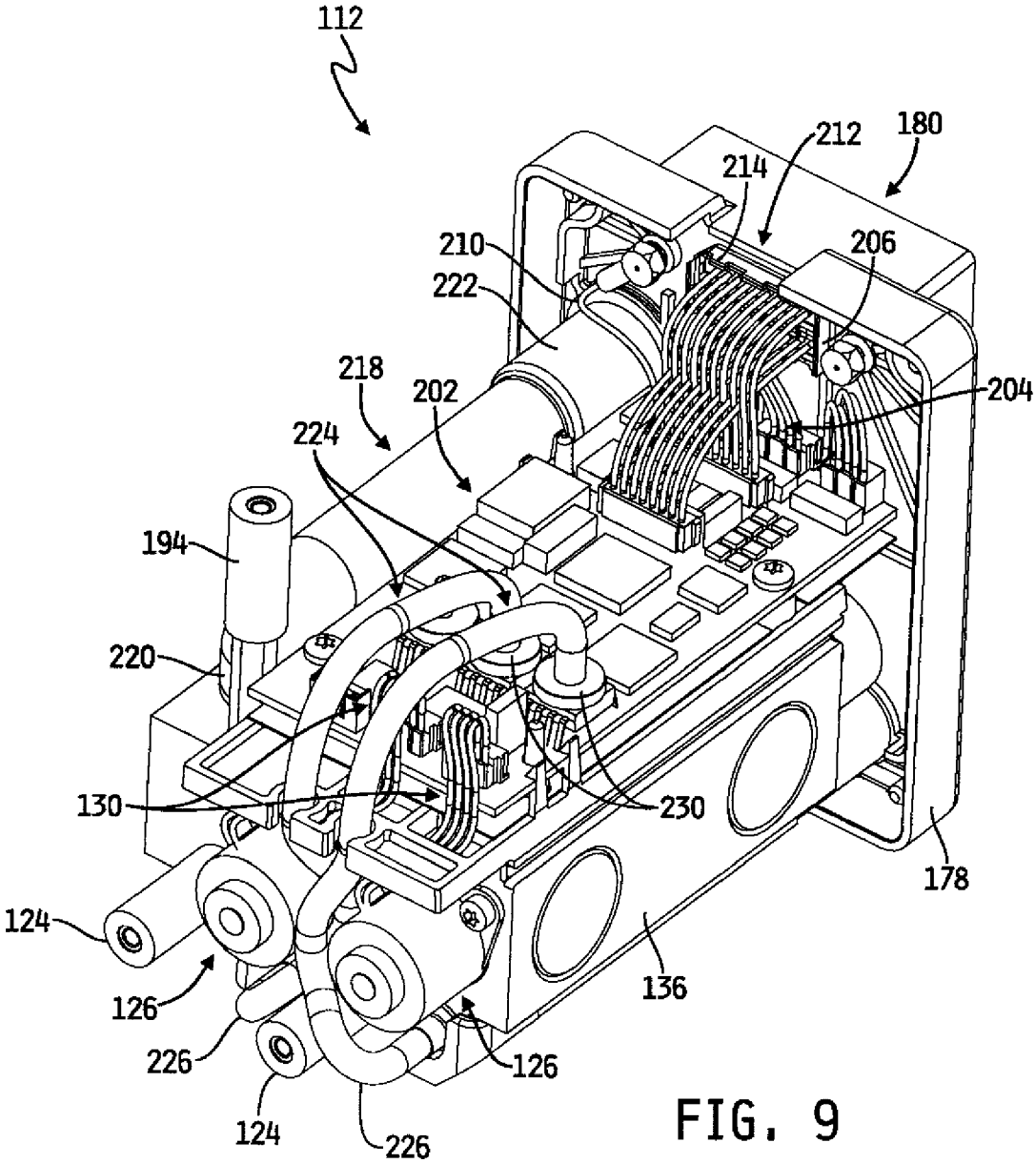
FIG. 9 is a perspective bottom view with portions removed of a modular therapy device operable to control the operation of the coverlet.
Figure 18:
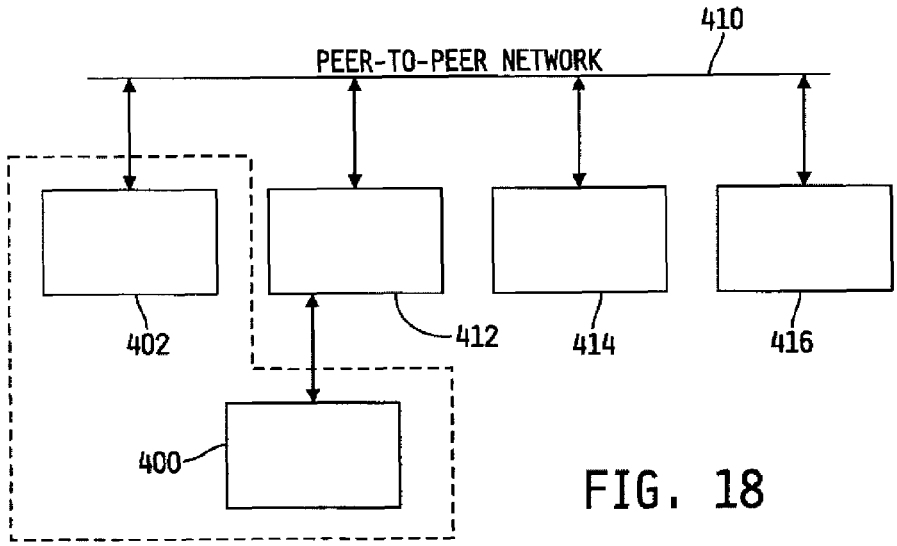
FIG. 18 is a diagrammatic representation of the electrical system of the patient-support apparatus of FIG. 1.

The integrated mattress assembly 14 includes a mattress 24 and a pneumatic supply and control system 26. The control system 26 in the illustrative embodiment is integrated with the frame 12 and shares power and control architecture with the frame 12 as shown in FIG. 18. It is within the scope of this disclosure for the mattress assembly 14 to be an independent apparatus positioned on the frame 12 and having a power and control architecture independent from the frame 12. The mattress 24 includes a coverlet 28, best seen in FIGS. 2-5, which is configured to communicate with a source of pressurized air 400, which is illustratively a blower. The pressurized air is routed and controlled by the control system 26 and introduced into an upper portion 30 of the coverlet 28. Upper portion 30 is configured to distribute the pressurized air as it flows from entry fittings 32 to an exhaust 34. Illustratively exhaust 34 is a single opening as depicted in FIGS. 6-8, or may embodied as a plurality of openings with closing a portion of the opening. Upper portion 30 includes an upper layer 36 and a lower layer 38. Each of the layers 36 and 38 includes a vapor permeable, air impermeable, water resistant layer of fabric. Upper portion 30 further includes a fire barrier 110. The flow of air through upper portion 30 tends to remove heat transferred from a patient to upper layer 36. This tends to cool the skin of the patient. Cooling of skin is known to reduce the potential for injury to the patient's skin.

Upper portion 30 further includes an intermediate layer 40 separating upper layer 36 and lower layer 38 to provide a flow path for the pressurized air. In the illustrative embodiment, the intermediate layer 40 comprises a batting, the batting including polyester fibers in a matrix which sufficiently separates upper layer 36 and lower layer 38 for air to flow therebetween. Illustratively, the intermediate layer is Spacenet manufactured by Freudenberg & Co. of Weinheim, Germany. In some embodiments, the intermediate layer 40 may include Tytex, available from Tytex Inc. of Rhode Island. Other woven, nonwoven, or knit breathable support materials or fabrics having resilient portions, microfilaments, monofilaments, or thermoplastic fibers may be used in other embodiments. Suitable materials for intermediate layer 40 and for layers 36 and 38 are also described in U.S. Published Patent Application 2006-0168736, entitled PRESSURE RELIEF SURFACE, filed Jan. 3, 2006, the disclosure of which is incorporated herein by this reference.

Illustratively, upper layer 36 comprises a urethane coated nylon which permits water vapor to pass through the upper layer 36 into the space between upper layer 36 and lower layer 38. The flow of pressurized air through upper portion 30 tends to remove the accumulated moisture. Thus, sweat from a patient passes through upper layer 36 and is removed. The removal of moisture is also known to reduce the potential for injury to the skin of a patient positioned on a mattress, such as the illustrative mattress 24.

Mattress 24 is illustratively configured as a therapy surface to address risk factors for various ailments experienced by persons confined to a patient-support apparatus for an extended period. For example, hospital bed 10 may be embodied as a TotalCare® Bariatric Bed available from Hill-Rom, Inc. of Batesville, Ind. Mattress 24 may be embodied as a TotalCare® Bariatric Plus Low Airloss surface for the TotalCare® Bariatric bed, also available from Hill-Rom. The mattress 24 as described herein includes structures specific to integration of the mattress with the TotalCare® Bariatric Bed or TotalCare® Bed System also available from Hill-Rom, Inc. However, these structures are illustrative only and do not limit the scope of any claims not reciting specific structures.

When referring to locations on the hospital bed 10, the terms "head end" and "foot end" are used generally to provide orientation and do not refer to specific features of the hospital bed 10. The terms "patient left" and "patient right" are used to provide orientation relative to a patient positioned on the hospital bed 10 lying in a supine position. As shown in FIG. 1, end panel 44 is oriented at the foot end 46 and an end panel 48 is oriented at a head end 50. Hospital bed 10 further includes four siderails: a right head rail 52, a right foot rail 54, a left head rail 56, and a left foot rail 58. Siderails 52, 54, 56 and 58 are movable between a barrier position as shown in FIG. 1 and a lowered position wherein the siderails 52, 54, 56 and 58 are below a top surface 60 of mattress 24. Two pads 600 and 602 are coupled to siderails 58 and 54 respectively. Pads 600 and 602 provide support for the legs of a bariatric patient when the hospital bed 10 is in the chair position as shown in FIG. 1. Hospital bed 10 includes a number of user inputs as are well known in the art. For example, a graphical display 608, a user input panel 604, and a user input panel 610 are all used by a caregiver to control operation of the patient-support apparatus.

Figure 10:
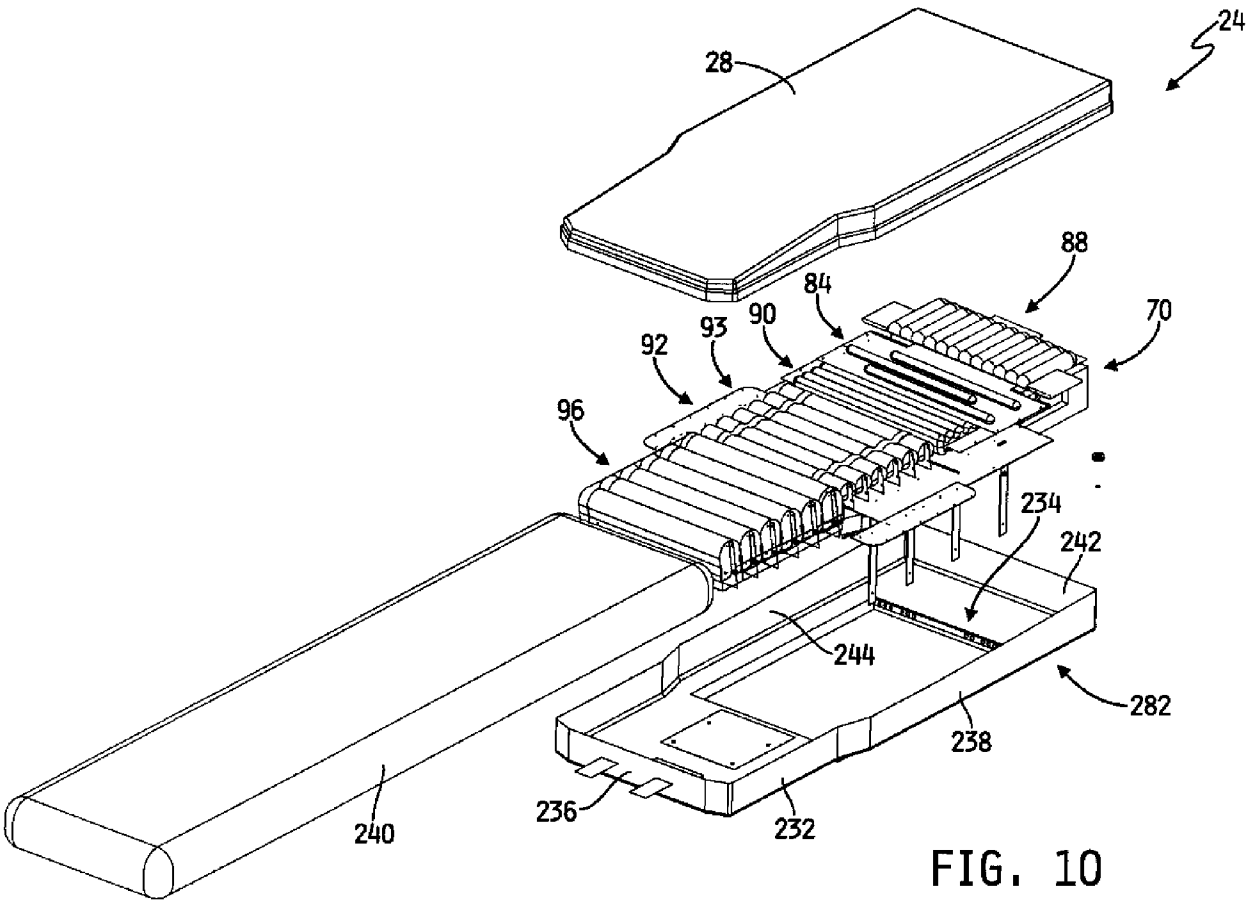
FIG. 10 is an exploded assembly view of the mattress assembly of FIG. 1.

A foot end 46 of mattress 24 is narrower than the remainder of mattress 24 as shown in FIG. 10. Coverlet 28 is configured to be attached to a mattress cover through a zipper (not shown) which is positioned about the perimeter of the lower mattress cover 282. It should be understood that coverlet 28 may be attached to a mattress cover through snaps, buttons, hook and loop fastening system, or may be fitted and include elastic to fit over the mattress 14 to be retained thereon.

Figure 11:
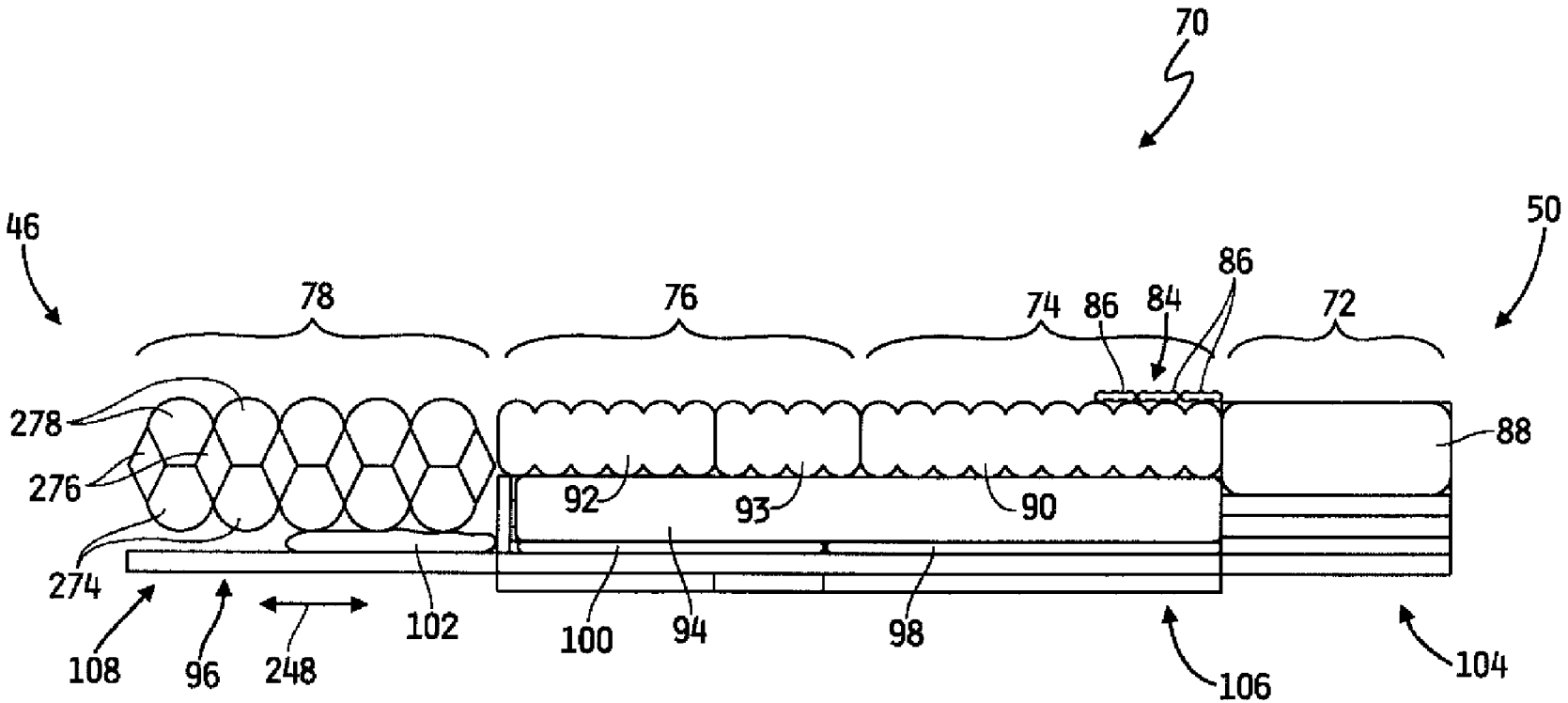
FIG. 11 is a diagrammatic side view of a portion of the mattress assembly with the coverlet and a cover removed.
Figure 14:
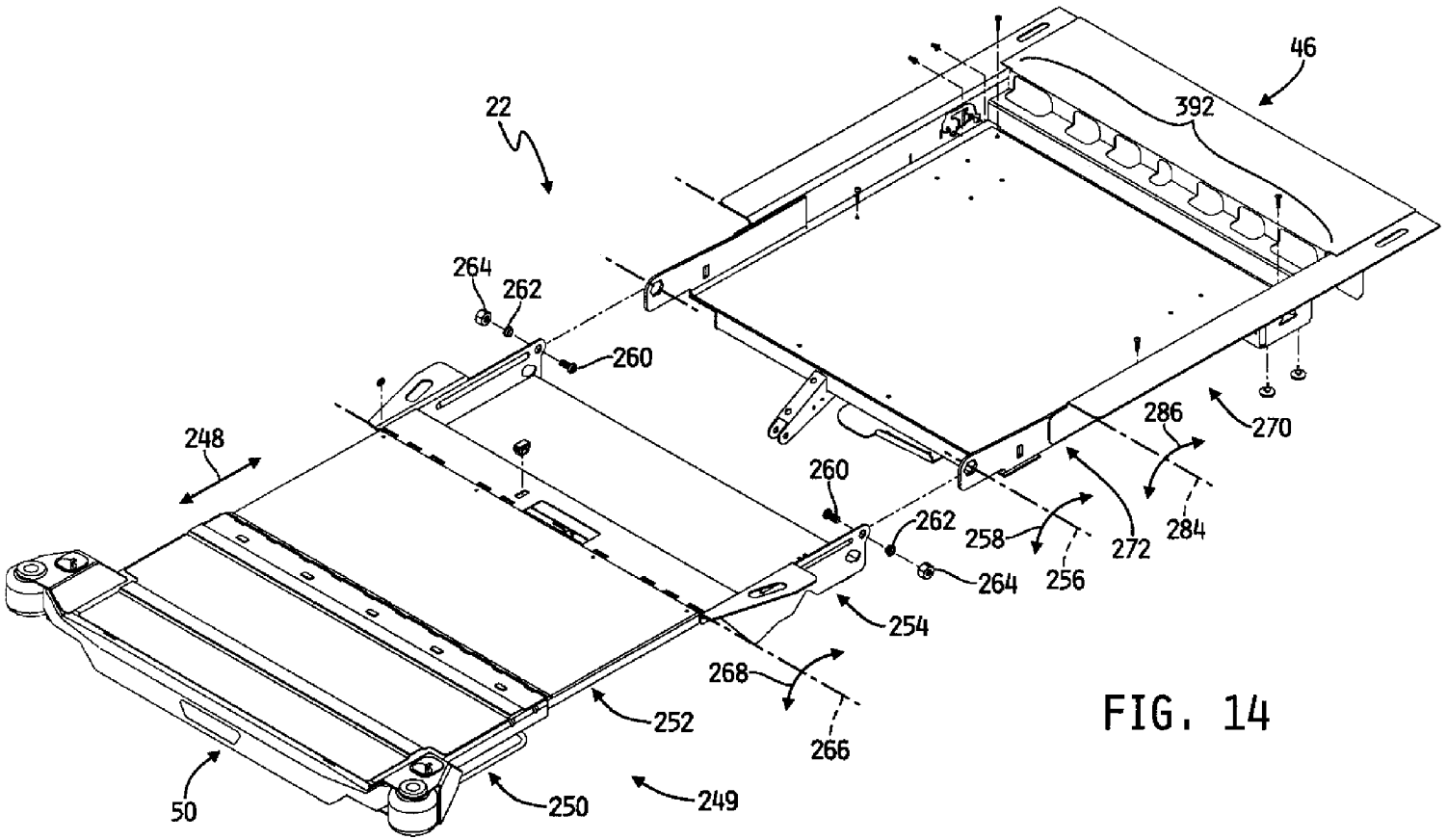
FIG. 14 is an exploded assembly view of an upper deck structure of the patient-support apparatus of FIG. 1; the deck structure configured to support the mattress assembly and to articulate relative to an upper frame assembly.

Mattress 24 further includes a fire barrier 240 and a patient-support structure 70. The support structure 70 includes multiple foam pieces and a number of enclosed volumes which are separately inflatable to provide therapy and support to a patient supported on the mattress 24. For purposes of discussion, the support structure 70 may be considered in four sections along the longitudinal length of the mattress 24 as shown in FIG. 11. For example, head section 72 is positioned at the head end 50 of the mattress 24. A torso section 74 is positioned adjacent the head section 72 and is configured to support the upper body of a patient on the mattress 24. A thigh section 76 is positioned adjacent the torso section 74 and is configured to support the upper legs of a patient. A foot section 78 is positioned at the foot end 46 of the mattress 24 and is positioned adjacent the thigh section 76. Foot section 78 is configured to change in length if a foot deck section 249 (best seen in FIG. 14) of the upper deck 22 is retracted to change a length of the upper deck 22 as depicted by arrow 248.

Referring now to the diagrammatic representation of support structure 70 in FIG. 11, a section of the mattress taken through the patient right side of the support structure 70 exposes various components of support structure 70. A percussion and vibration assembly 84 includes three percussion and vibration bladders 86 which are positioned on the torso section 74 near the head section 72 of the structure 70. The percussion and vibration bladders 86 are independently and alternately inflatable to expand rapidly to impart a force to a chest area of a patient supported on mattress 24. The percussive forces of the percussion and vibration assembly 84 reduce the potential for fluid to accumulate in the lungs of a patient by mechanically releasing secretions which accumulate and adhere to lung tissue.

A head structure 88 positioned in the head section 72 is illustratively a series of interconnected air cells which form a single inflatable volume to provide support to the head of a patient supported on structure 70 of mattress 24. A torso structure 90 also illustratively includes a series of interconnected air cells forming an inflatable volume to support the torso of a patient on structure 70 of mattress 24. A seat structure 93 is positioned in the thigh area 76 and includes a series of interconnected cells to support the seat of a patient on the structure 70. A thigh structure 92 is positioned in the thigh area 76 and includes a series of interconnected air cells to support the thigh area of a patient on the structure 70. As will be described in further detail below, torso section 74 is pivotable relative to thigh section 76. Head structure 88, torso structure 90, seat structure 93, and thigh structure 92 are each inflated and pressurized to pressures which tend to reduce the potential of injury to the skin of a patient supported on mattress 24.

A foot structure 96 of support structure 70 is positioned at a foot section 78. Foot structure 96 includes a plurality of bladders connected together. Foot structure 96 includes a lower set of collapse bladders 274 which are plumbed together to form a single volume. A series of retraction bladders 276 are coupled to collapse bladders 274 and the retraction bladders 276 are plumbed together to form a second volume separate from the volume formed by collapse bladders 274. A series of heel bladders 278 are coupled to both the collapse bladders 274 and retraction bladders 276 with the heel bladders 278 being plumbed together to form yet another single volume. In the illustrative embodiment, foot section 78 is retractable and collapsible when the hospital bed 10 is articulated to a chair position such as the position shown in FIG. 1, for example. By inflating the retraction bladders 276, the foot structure 96 is extended, whereas deflating the retraction bladders 276 retracts the foot structure 96 to shorten the length. Similarly, deflating collapse bladders 274 reduces the thickness of foot structure 96. For example, if the foot section 78 is articulated downwardly relative to the thigh section 76, the thickness of foot structure 96 may be reduced to improve the comfort of a patient supported on mattress 24. Heel bladders 278 are pressurized in a manner which reduces the potential for injury to the skin of a patient supported on mattress 24.

Figure 22:
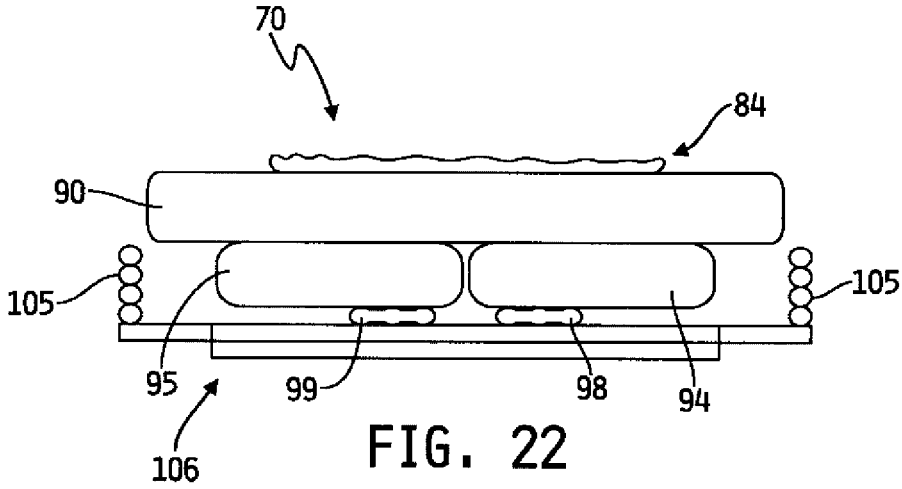
FIG. 22 is an end view of a portion of the mattress assembly of FIG. 1 in normal operation.
Figure 23:
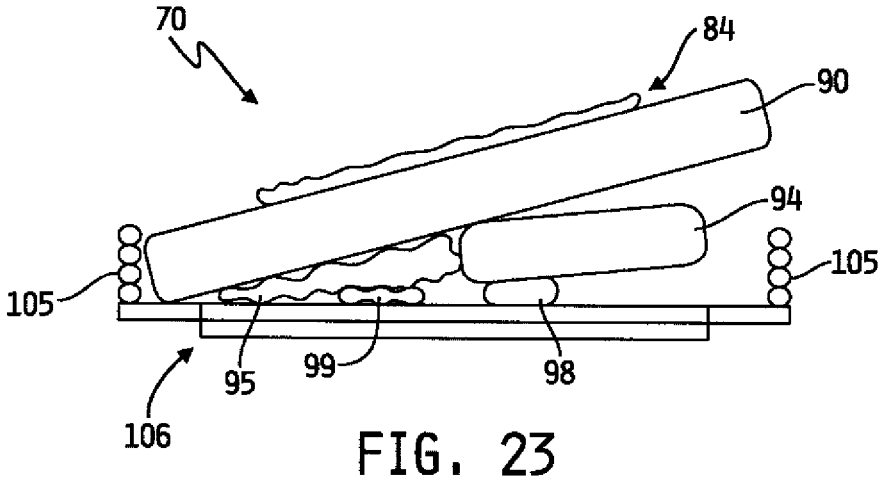
FIG. 23 is an end view similar to FIG. 22 with the mattress configured to rotate a patient in a first direction.
Figure 24:
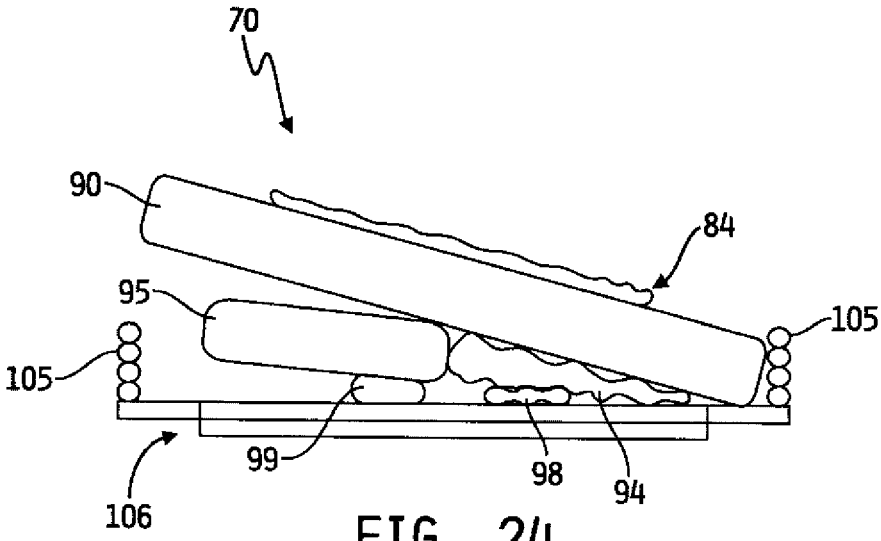
FIG. 24 is an end view similar to FIG. 23 with the mattress configured to rotate a patient in a second direction opposite the first.
Figure 25:
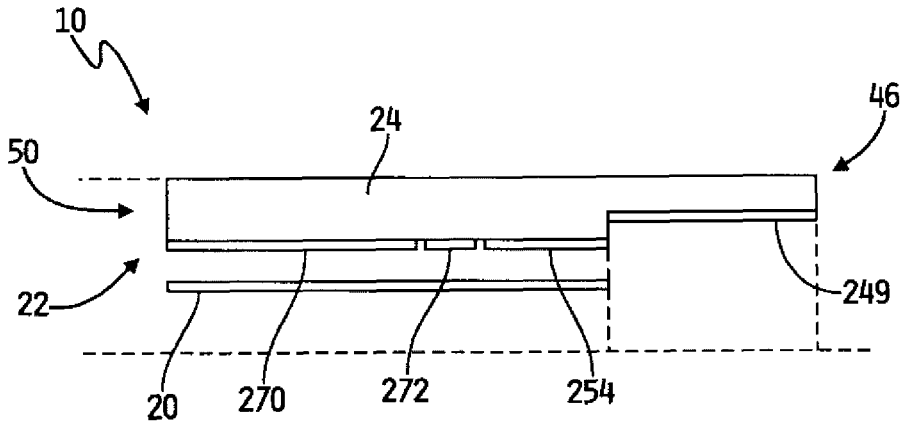
FIG. 25 is a diagrammatic representation of the upper frame and upper deck of the patient-support apparatus with the upper deck in a generally flat position and the upper frame in a generally horizontal position.
Figure 26:
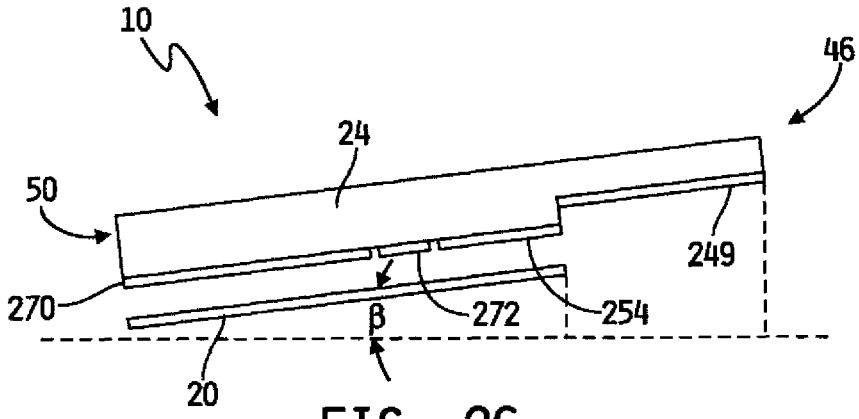
FIG. 26 is a diagrammatic representation of the upper frame and upper deck of the patient-support apparatus in a tilt position with the head end of the patient-support apparatus lower than the foot end of the patient-support apparatus.
Figure 27:
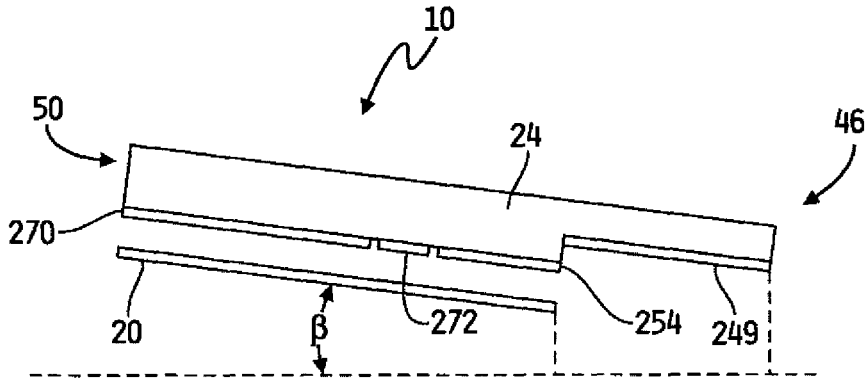
FIG. 27 is a diagrammatic representation of the upper frame and upper deck of the patient-support apparatus in a reverse tilt position with the head end of the patient-support apparatus higher than the foot end of the patient-support apparatus.
Figure 28:
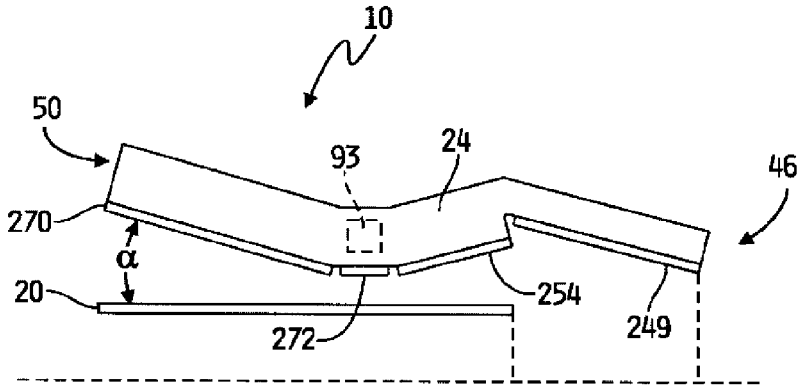
FIG. 28 is a diagrammatic representation of the upper frame and upper deck of the patient-support apparatus with portions of the upper deck section partially articulated.
Figure 29:
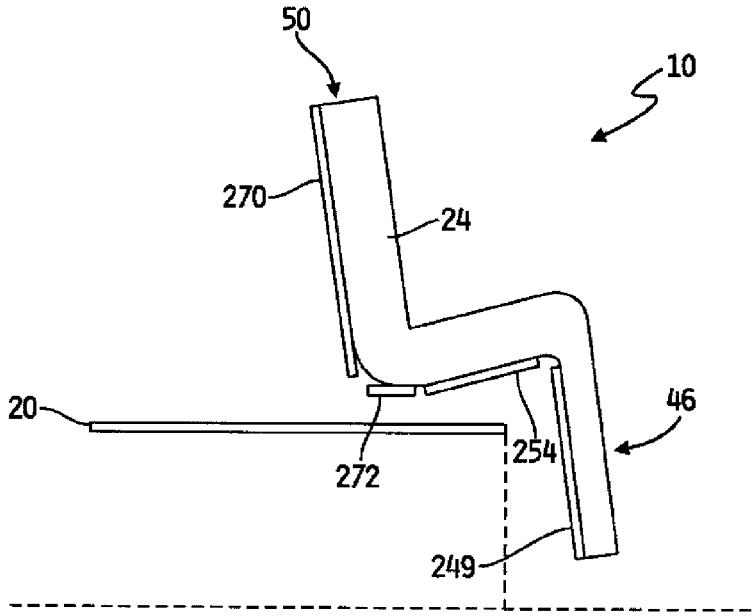
FIG. 29 is a diagrammatic representation of the upper frame and upper deck of the patient-support apparatus with portions of the upper deck section articulated to the chair position of FIG. 1.
Figure 30:
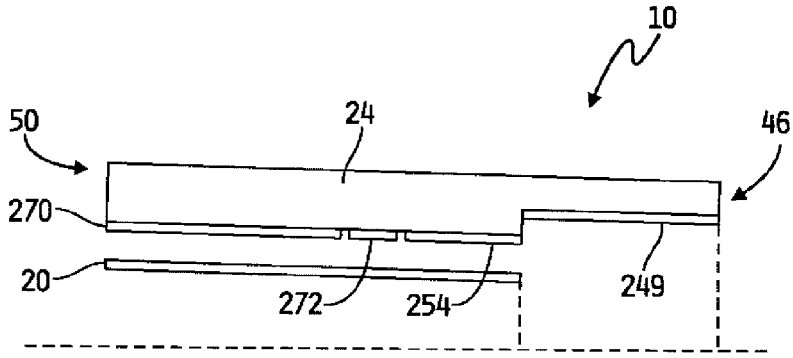
FIG. 30 is a diagrammatic representation of the upper frame and upper deck of the patient-support apparatus in a reclined position.
Figure 31:
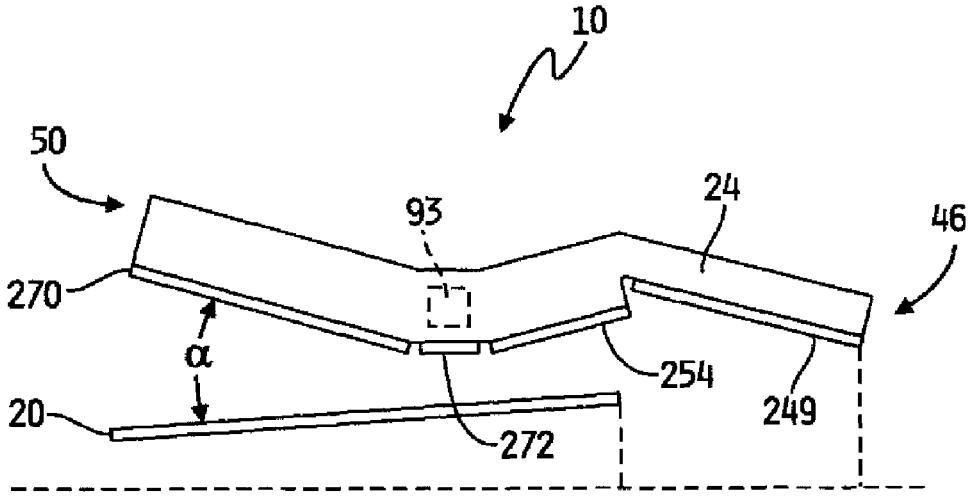
FIG. 31 is a diagrammatic representation of the upper frame and upper deck of the patient-support apparatus in a tilt position with the head end of the patient-support apparatus lower than the foot end of the patient-support apparatus and with portions of the upper deck section partially articulated.
Figure 32:
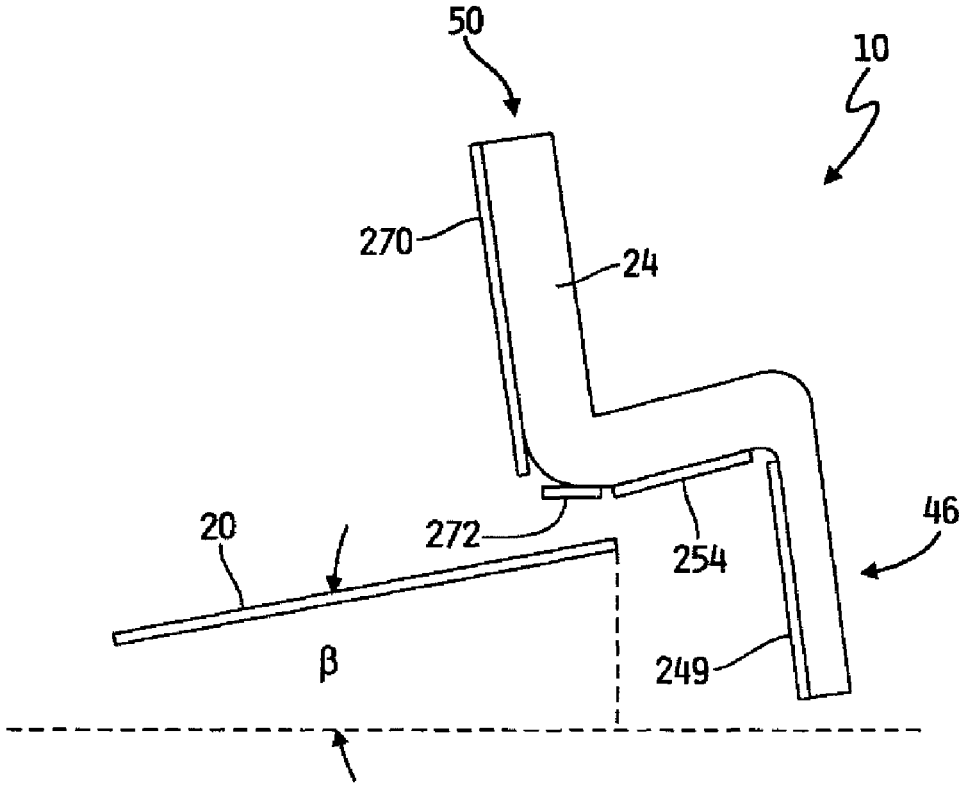
FIG. 32 is a diagrammatic representation of the upper frame and upper deck of the patient-support apparatus in a tilt position with the head end of the patient-support apparatus lower than the foot end of the patient-support apparatus and with portions of the upper deck section articulated to a chair position.

Mattress 24 is configured to provide continuous lateral rotation therapy (CLRT) to a patient supported on mattress 24. CLRT is the process of rotating a patient laterally on a patient-support surface, such as mattress 24. Application of CLRT by the structure 70 is depicted diagrammatically in FIGS. 22-24. FIGS. 22-24 represent a cross-section of structure 70 taking through torso section 74 and viewed from the head end 50 of structure 70. Torso structure 90 supports percussion and vibration assembly 84 upon which a patient is positioned in a supine position. In the illustrative embodiment of FIGS. 22-24, torso structure 90 is supported on a left working cushion 95 and a right working cushion 94. Working cushions 94 and 95 are normally inflated when a patient is supported on mattress 24. A smaller rotation structure is positioned under each of the working cushions 94 and 95. A left torso rotation structure 99 is positioned under left working cushion 95 and a right torso rotation structure 98 is positioned under right working cushion 94. In normal operation, torso rotation structures 98 and 99 are deflated. During CLRT, a patient is rotated by deflating one of the working cushions and inflating the opposite rotation structure. For example, to rotate a patient to the patient's left, left working cushion 95 is deflated and right torso rotation structure 98 is inflated as depicted in FIG. 23. To rotate a patient to the patient's right, right working cushion 94 is deflated and left torso rotation structure 99 is inflated as depicted in FIG. 24. The degree of rotation can be controlled by controlling the pressures in the working cushions and the rotation structures to limit the amount of rotation experienced by the patient during CLRT.

Figure 12:
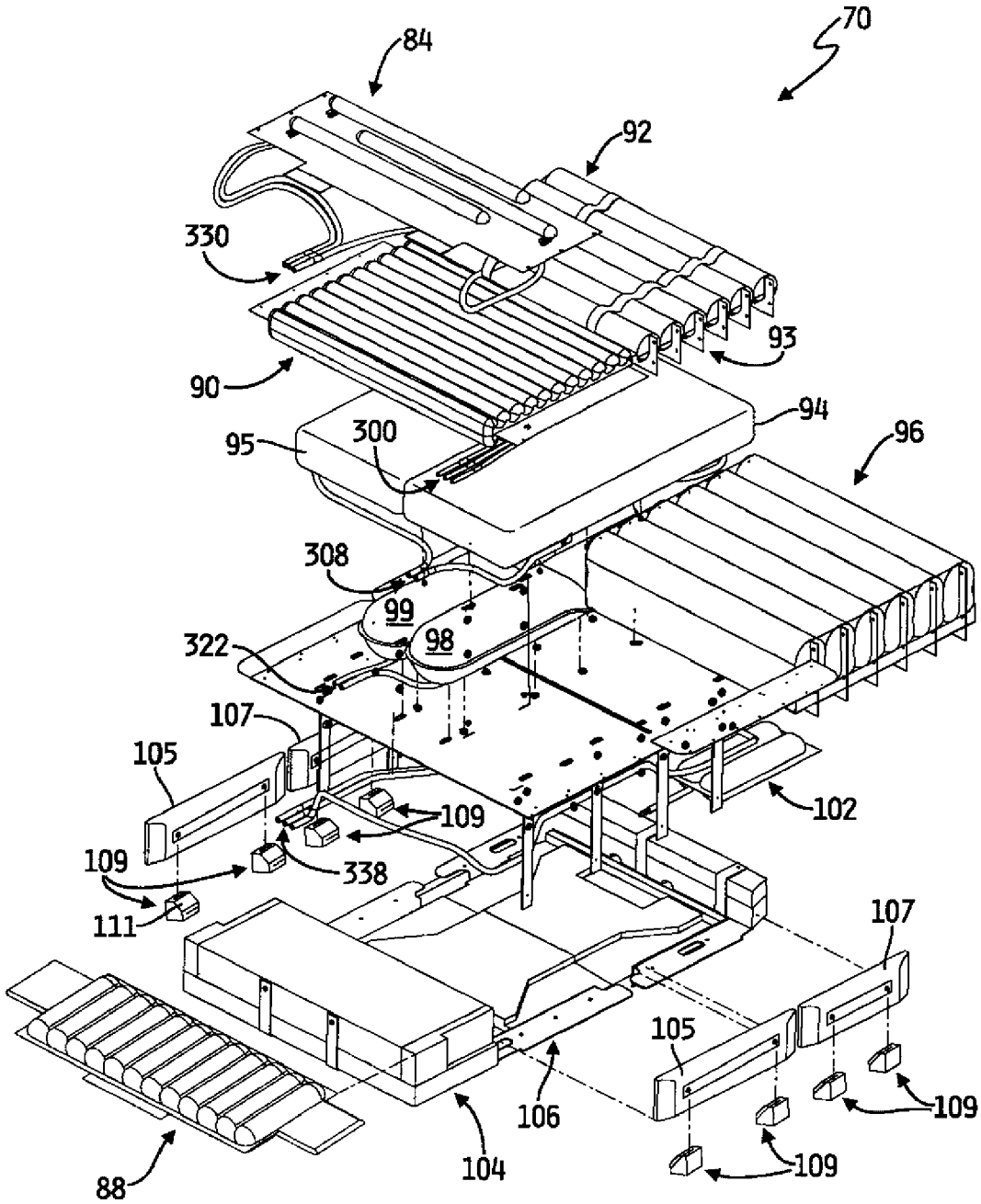
FIG. 12 is a perspective view of an exploded assembly of a portion of the mattress assembly of FIG. 1, the perspective view taken from the patient's right head end of the patient-support apparatus.
Figure 13:
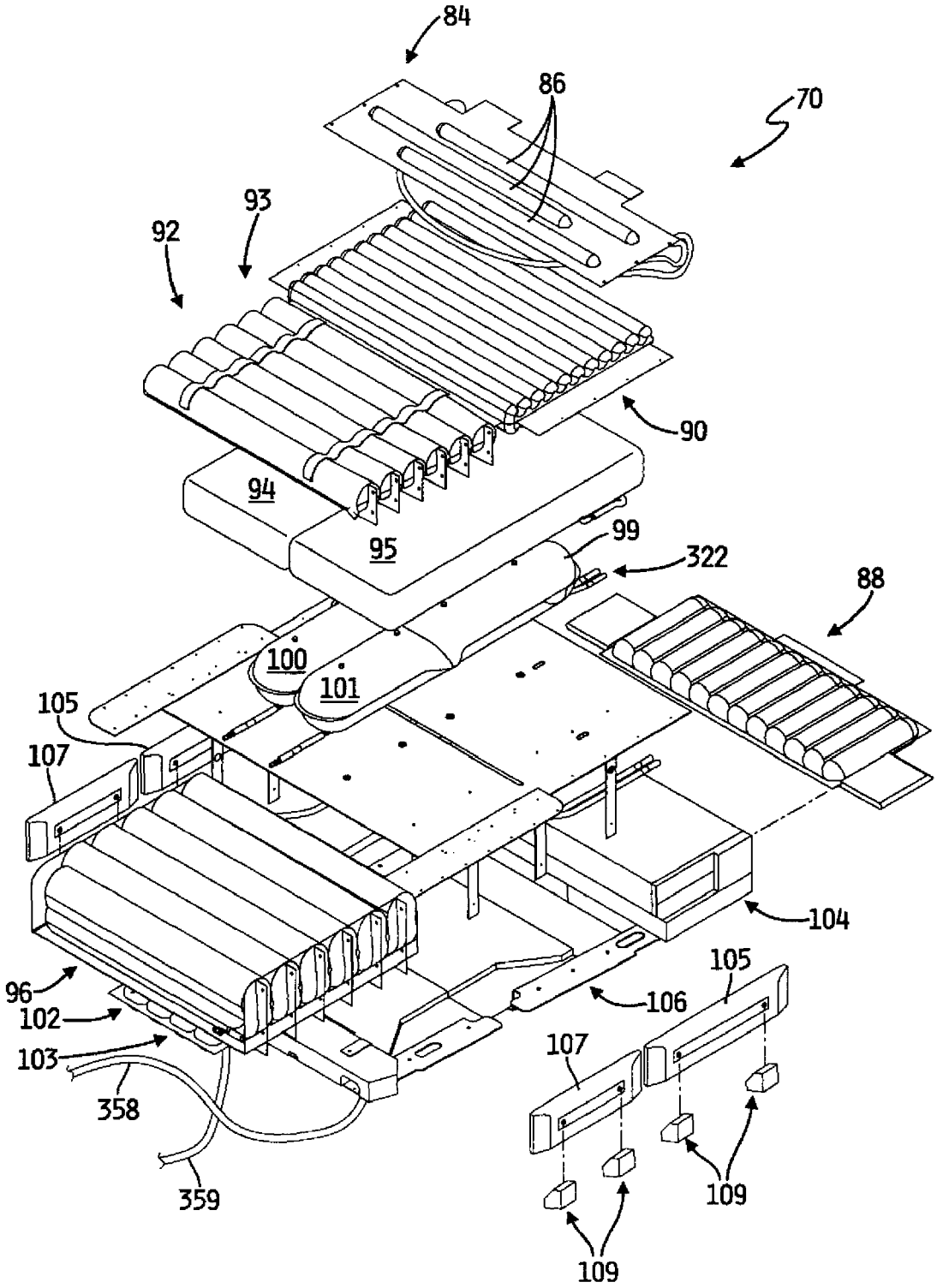
FIG. 13 is a perspective view similar to FIG. 12 taken from the patient's left foot end of the patient-support apparatus.

Referring now to FIGS. 12 and 13, support structure 70 further includes a left thigh rotation structure 101 and a right thigh rotation structure 100 positioned under the working cushions 95 and 94 respectively. The thigh rotation structures 100 and 101 are positioned under the thigh section 76 of structure 70. In addition, a left foot rotation structure 103 and a right foot rotation structure 102 are positioned in the foot section 78 of structure 70. All three of the left rotation structures 99, 1017 and 103 are plumbed together in a single volume such that the inflation and deflation of structures 99, 101, and 103 occurs simultaneously under the control of the pneumatic supply and control system 26. Similarly, right rotation structures 98, 100, and 102 are plumbed together and controlled as a unit by pneumatic supply and control system 26.

Structure 70 further includes a head support 104 positioned in head section 72 below head structure 88 and configured to support head structure 88 relative to upper deck 22. A body support 106 is positioned under torso section 74 and thigh section 76 to support the various rotation structures, working cushions, and the torso structure 90, thigh structure 92 and seat structure 93 relative to the upper deck 22. A foot support 108 is positioned under foot structure 96 and rotation structures 102 and 103 to support those components relative to the upper deck 22. In addition, a large bolster 105 is positioned on both the left side and a right side of structure 70 engaging head support 104 and extending longitudinally along the perimeter of structure 72 the interface between the torso section 74 and thigh section 76. A small bolster 107 extends longitudinally from large bolster 105 the links of thigh section 76 on both sides as structure 70. The bolsters 105 and 107 comprise a foam material and provide an interface between the various bladders of structure 70 in the components of upper deck 22. Two spacers 109 are coupled to each of the bolsters 105 and 107, the spacers providing support for the bolsters 105 and 107 by engaging the upper deck 22 through the mattress cover.

Figure 16:
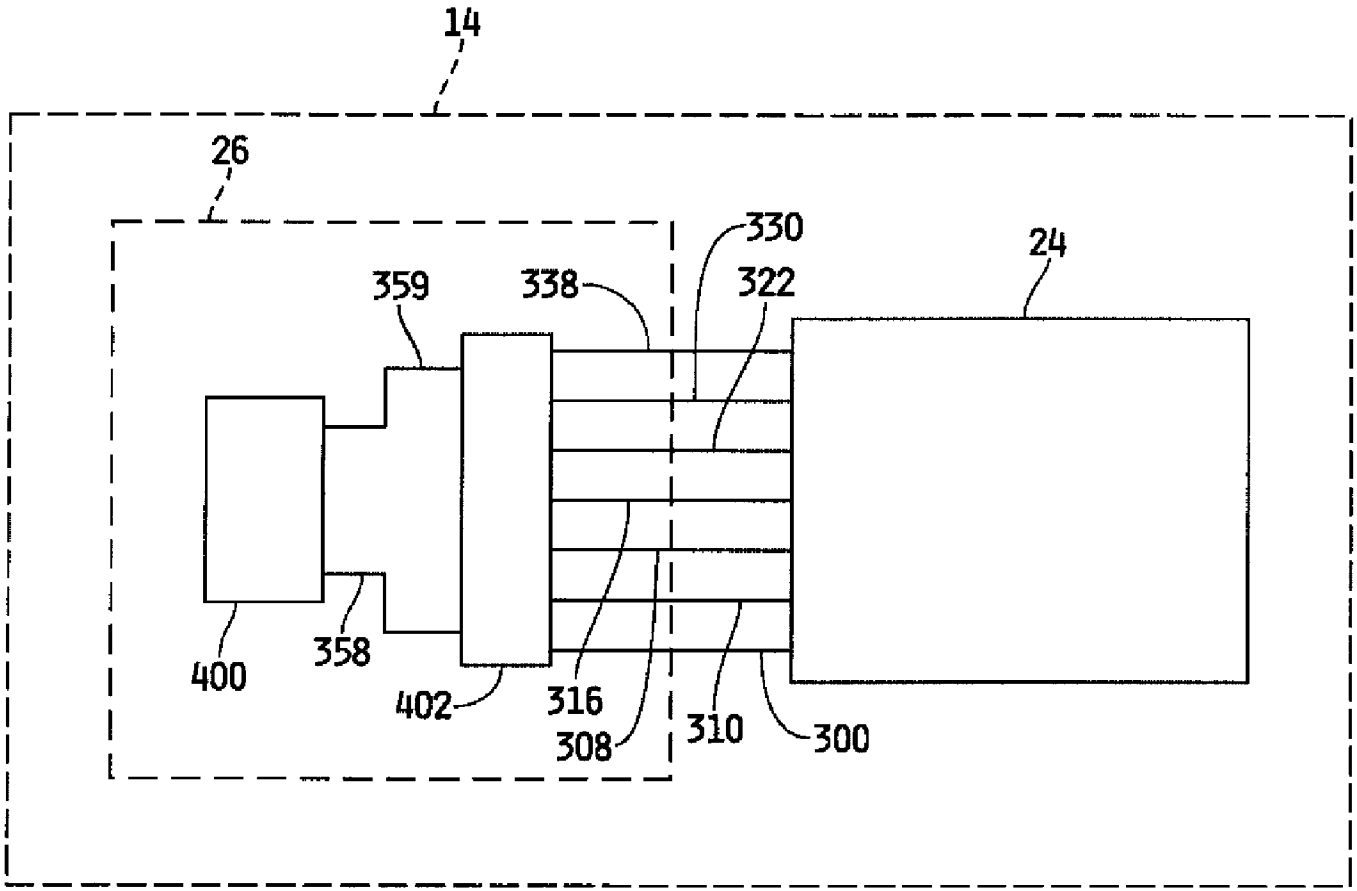
FIG. 16 is a diagrammatic view of the mattress assembly of FIG. 1.
Figure 17:
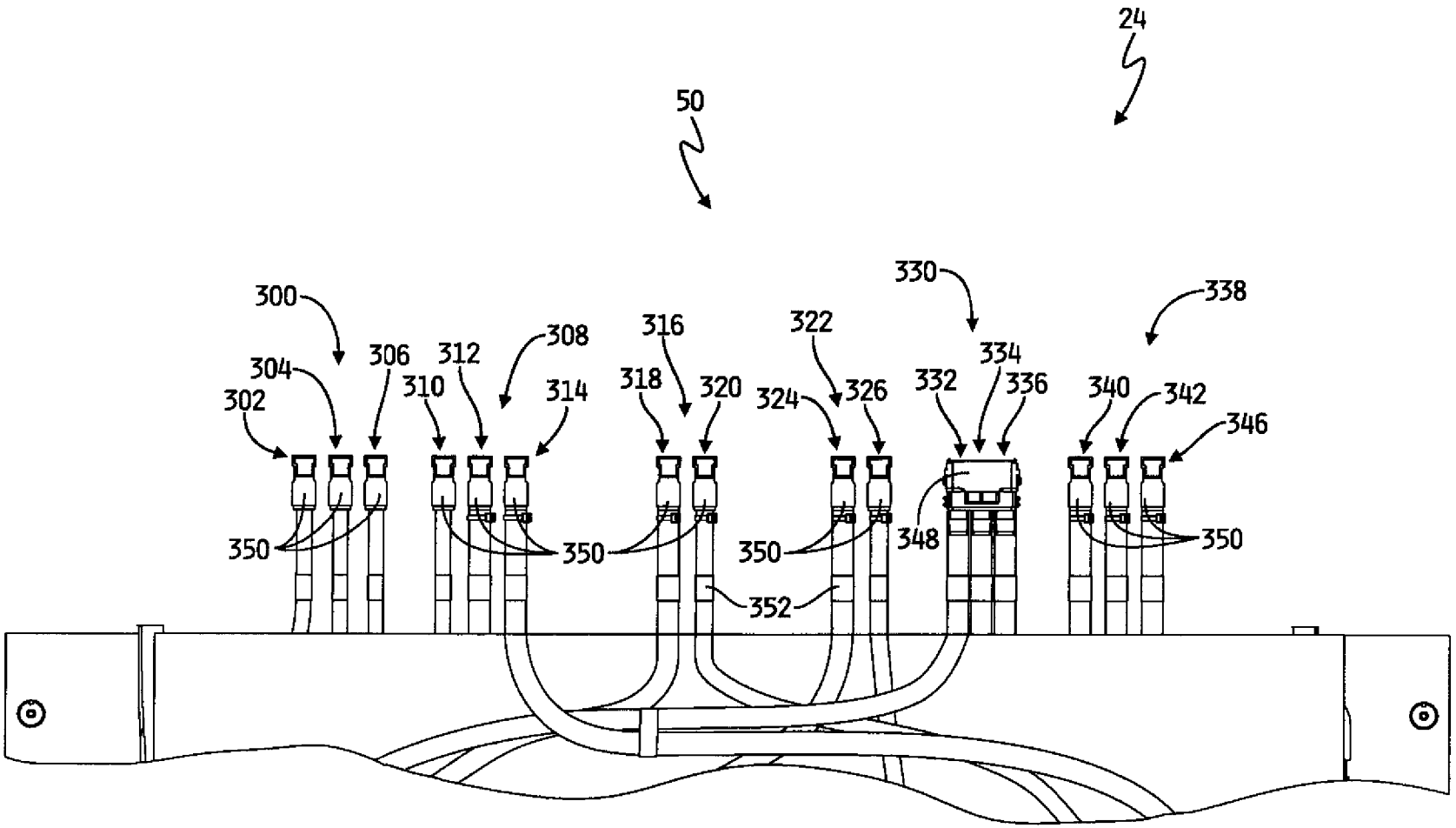
FIG. 17 is a view of a portion of the mattress assembly of FIG. 1 with various pneumatic connections extending from the mattress assembly and positioned to engage the modular control assembly of FIG. 15.

The relationship of various components of the mattress assembly 14 is represented diagrammatically in FIG. 16. A blower 400 communicates pressurized air to a control assembly 402 through two conduits 358 and 359. Control assembly 402 communicates with various bladders in mattress 24 through a series of interfaces which include one or more conduits communicating to the various bladders. The interfaces to the mattress 24 are shown in further detail in FIG. 17 in which a treatment cushions interface 300 includes a thigh cushion conduit 302, a seat cushion conduit 304, and a chest cushion conduit 306. Thigh cushion conduit 302 communicates with thigh structure 92. Seat cushion conduit 304 communicates with seat structure 93. Chest cushion conduit 306 communicates with torso structure 90. In the illustrative embodiment described herein, a single conduit provides pneumatic communication between control assembly 402 and a single closed volume. Control assembly 402 is configured to either provide a source of pressurized air to each of the closed volumes to provide inflation, or to provide and exhaust path to remove air from the closed volume to thereby deflate the closed volume. The interface for head structure 88 is a single head cushion conduit 310.

Control assembly 402 communicates to the working cushions through a working cushions interface 308 which includes a right working cushion conduit 312 connected to the right working cushion 94 and a left working cushion conduit 314 which connected to left working cushion 95. Control assembly 402 communicates with coverlet 28 through a low-airloss interface 316 which includes a right air loss conduit 318 and a left air loss conduit 320. Conduits 318 and 320 are connected to the two entry ports 32 of coverlet 28 shown in FIGS. 2-5. A boost cushions interface 322 communicates from control assembly 402 to the rotational structures which are inflated to boost the rotation of a patient supported on mattress 24. Boost cushions interface 322 includes a right boost cushion conduit 324 which communicates to right rotation structures 98, 100, and 102. Boost cushions interface 322 also includes a left boost cushion conduit 326 which communicates with left rotation structures 99, 101, and 103.

A percussion and vibration interface 330 communicates from the control assembly 24 to the percussion and vibration assembly 84. The percussion and vibration assembly 84 includes the three percussion and vibration bladders 86. Conduit 332 of percussion and vibration interface 330 communicates with the middle percussion a vibration bladder 86. Conduit 334 of percussion and vibration interface 330 communicates with a lower percussion and vibration bladder 86 positioned to toward the foot end 46 of mattress 24. Conduit 336 of percussion a vibration interface 330 communicates with the percussion and vibration bladder 86 positioned toward the head end 50 of mattress 24. The control system 24 is operable to selectively and alternately inflate the three percussion and vibration bladders 86 to impart an impact to the chest area of a patient positioned on mattress 24. The impacts of rapidly expanding bladders 86 tends to assist in loosening secretions which may stick to lung tissue because of various pulmonary complications as is known in the art.

Control system 24 communicates with foot structure 96 through a foot cushions interface 338. Foot cushions interface 338 includes a collapse bladders conduit 340 which is connected to collapsible bladders 274 of foot structure 96. A retraction bladders conduit 342 of foot cushions interface communicates between control system 402 and retractor bladders 276 of foot structure 96. Foot cushions interface 338 further includes a heel bladder conduit 346 which communicates from control system 402 to heel bladders 278.

Figure 15:
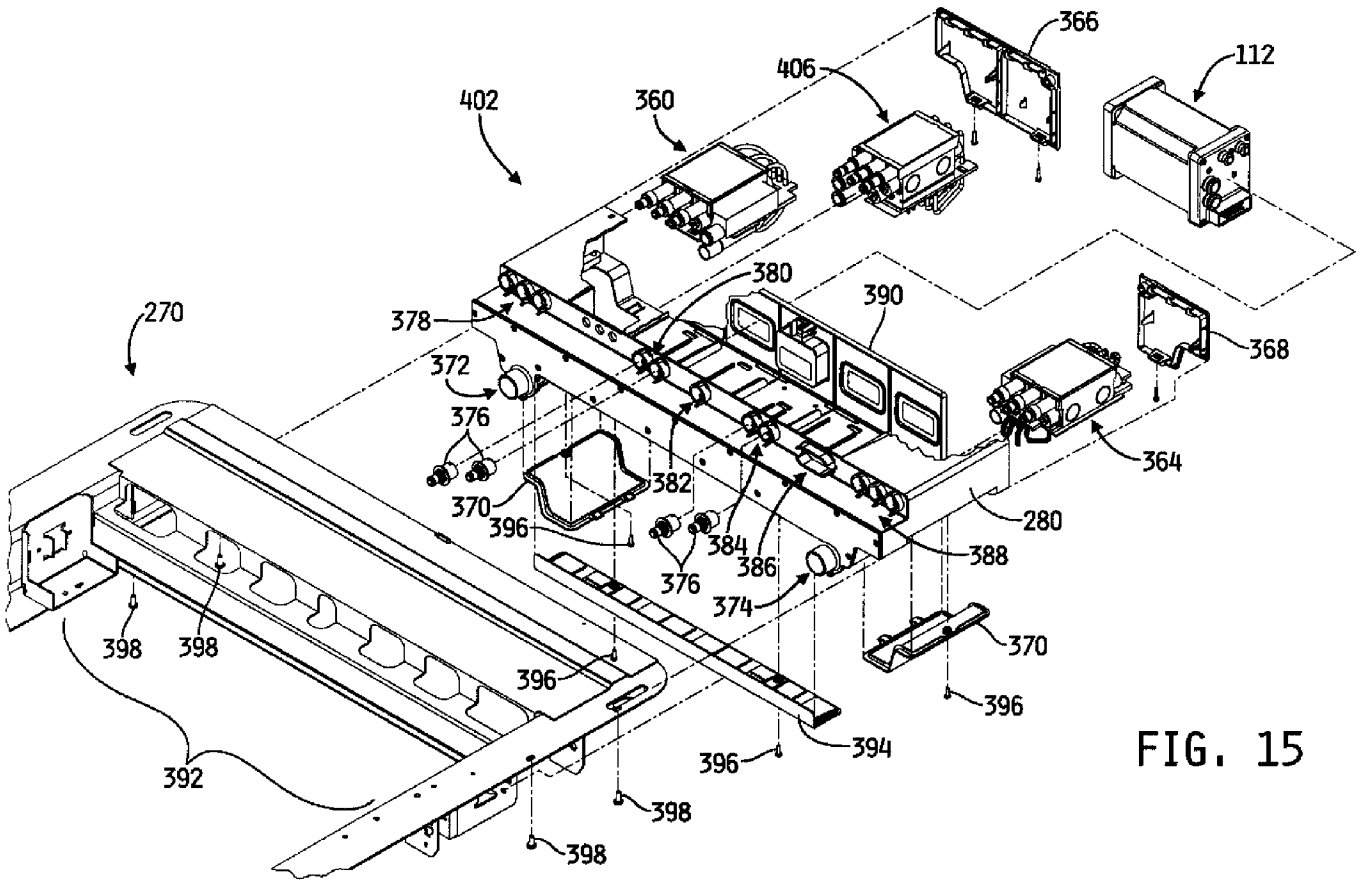
FIG. 15 is an exploded assembly view of a modular control assembly of the mattress assembly of FIG. 1, the modular control assembly coupled to the upper deck structure of FIG. 14.
Figure 21:
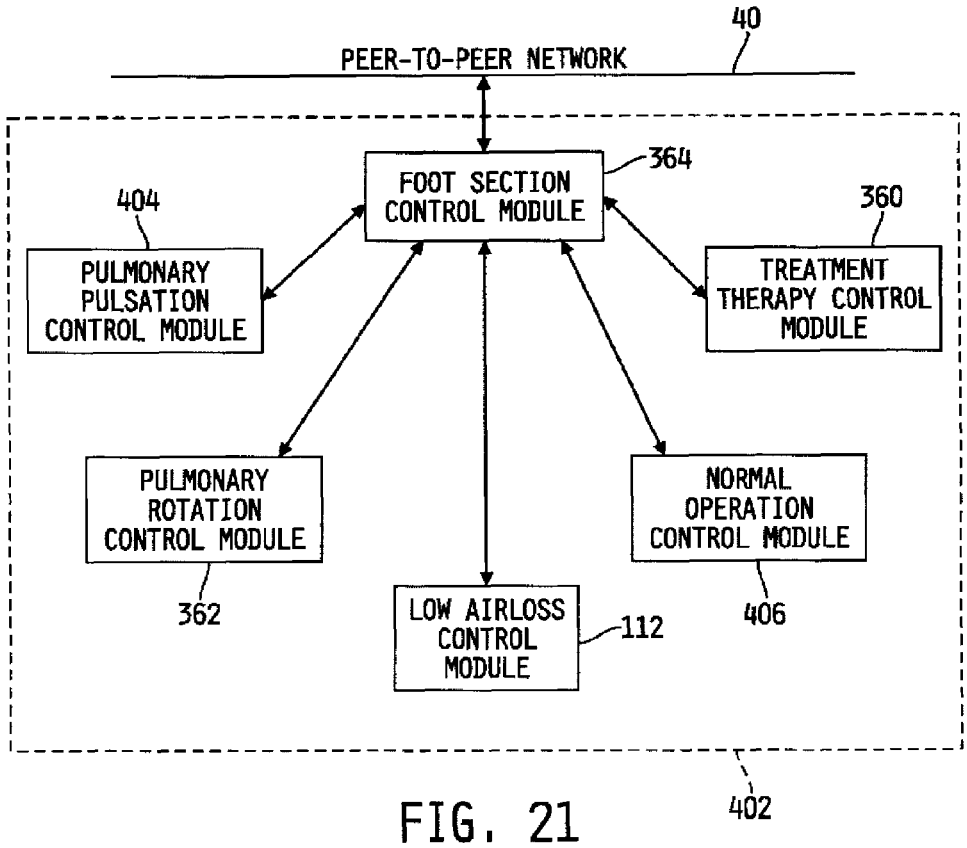
FIG. 21; is a diagrammatic representation the electrical system of the modular control assembly of FIG. 15.

Control system 402 has a modular construction as shown in FIGS. 15 and 21. Referring to FIG. 21, the electrical relationship between various control modules of control system 402 is shown and includes a peer-to-peer network connection between foot section control module 364 and a peer-to-peer network 410 of hospital bed 10. The remaining control modules are all electrically connected to foot section control module 364 and control various aspects of the operation of mattress assembly 14. A treatment therapy control module 360 controls the operation of torso structure 90, thigh structure 92, and seat structure 93 through treatment cushions interface 300 which couples to treatment ports 378 shown in FIG. 15. Normal operation control module 406 is electrically connected to foot section control module 364 and interfaces with head cushion conduit 310 and a working cushions interface 308. The normal operation control 406 controls operation of head structure 88 and working cushions 94 and 95. Low-airloss control module 112 communicates with coverlet 28 through low-airloss interface 316 which couples to two fittings 376, 376 which are inserted into low-airloss port 380 when low-airloss control module 112 is present in control assembly 402. The relationship of pulmonary pulsations control module 404 and pulmonary rotation control module 362 to foot section control module 364 is shown in FIG. 21. The control modules 404 and 362 are omitted from FIG. 15. Control modules 112, 362, and 404 are optional and may be removed when rotational or percussion and vibration therapies are not needed for a particular patient. However, if pulmonary pulsations control module 404 is present in control assembly 402, percussion and vibration interface 330 is connected to a percussion and vibration port 386 shown in FIG. 15 such that percussion vibration therapy can be delivered from the pulmonary pulsations control model 404. Similarly pulmonary rotation control module communicates with the rotation structures through boost cushions interface 322 which is coupled to two fittings 376 which are received into boost ports 384.

Control assembly 402 includes a housing 280 into which each of the control modules 360, 362, 364, 112, 404, and 406 are received. Housing 280 includes electrical connections between the various control modules and acts as a manifold through which pressurized air from blower 400 is distributed. Blower 400 may also deliver vacuum pressure to housing 280 to assist in deflating various inflatable structures. The pressure in the manifold portion of housing 280 is controlled to provide a stable pressure source to the various control modules. When inserted into housing 280, each of the control modules 360, 362, 364, 112, 404, and 406 engages with the manifold structure to receive pressurized air and complete the electrical connection necessary to configure control assembly 402 for the particular options to be used in mattress 24. In this way, mattress assembly 14 is configurable to add and remove low-airloss therapy, rotation therapy, and percussion and vibration therapy as necessary for the needs of any particular patient. Housing 280 is secured to head deck section 270 of upper deck 22 through several fasteners 398 the ports of control assembly 402 are received through several apertures head deck section 270 at deck interface 392.

The peer-to-peer network 410 further includes a power control module 412, a scale model 414, and a user interface module 416 each of which is connected to the peer-to-peer network such that operational information is shared between the various modules and control assembly 402. For example power control module 412 receives information from control assembly 402 to power on the blower 400. The peer-to-peer network 410 facilitates the expansion of capabilities of the hospital bed 10 by permitting various features to be added as necessary with chain vacation between the various modules being facilitated by the peer-to-peer network 410.

When assembled, control assembly 402 receives pressurized air through conduit 358 which is coupled to a port 374 of housing 280, and through conduit 359 which is coupled to a port 372 of housing 280. When treatment therapy control module 360 and normal operation control module 406 are installed in housing 280, a cover 366 is coupled to housing 280 to cover modules 360 and 406. Similarly when foot section control module 364 is positioned in housing 280, a cover 368 is coupled to the housing 280. Modules 360, 364, and 406 are present in all configurations of control assembly 402. Therefore covers 366 and 368 are generally fixed. A hinged cover 390 is coupled to housing 280 and pivotable relative thereto. Cover 390 opens to permit insertion of low-airloss control module 112, pulmonary pulsation control module 404, or pulmonary rotation control module 362 which changes the operational characteristics of mattress assembly 14 to provide a traditional therapies as necessary. Cover 390 snaps closed and is releasable to open to install the optional modules. Two covers 370 are positioned on the lower surface of housing 280 on each side of housing 280 and are secured with a fastener 396. Removal of one or both of the covers 370 permits access to the foot section control module electoral connections or the treatment therapy control module electrical connections. An additional cover 396 is positioned on the lower surface of housing 280 and when removed provides access to the manifold portion of housing 280 to allow the housing 280 to be configured to receive the optional control modules. Cover 394 is secured by two fasters 396.

The addition of the optional control models and additional control features to a patient-support apparatus has been disclosed previously in various patents. U.S. Pat. No. 5,781,949, for example, discloses the addition of rotation therapy. U.S. Pat. No. 6,119,291 discloses a percussion and vibration therapy apparatus. U.S. Pat. No. 6,047,424 discloses the use of modular therapy devices on a hospital bed. In the present disclosure, the modular addition of low-airloss therapy using a zipped on coverlet and an optional control module as disclosed herein provides additional functionality to that disclosed in the prior art. The addition of a low-airloss control module 112 allows a hospital to reconfigure a patient-support apparatus, such as hospital bed 10, for example, for the specific needs of a patient and thereby reduces the need for the functionality to be president and all patient-support apparatuses owned by the hospital. Because low-airloss therapy is not indicated in all cases, only those patients for which the therapy is indicated need to have the therapy available. Modifiable and adaptable patient-support apparatuses permit the hospital to control cost on delivering optimum therapy.

The low-airloss module 112 contains both pneumatic and electrical hardware necessary to control the operation of coverlet 28. The pneumatic structure includes a manifold 136 and four valve assemblies 126 which are coupled to the manifold 136 and are operable to control the flow of pressurized air through the manifold 136. The connection between the low-airloss control module and the right and left air loss conduits 318 and 320 is facilitated by a pair of seals 168, 168. Each seal 168 includes a seal body 170 and a seal flange 172. Each seal flange 172 is configured to couple to a fitting 350 of conduits 318 and 320. Each seal 168 is engaged with a bladder fitting 146 which is received in bladder ports 156 of manifold 136. A seal 150, illustratively embodied as an o-ring, is interposed between the bladder fitting 146 and the bladder port 156 to form a pneumatic seal therebetween.

Low-airloss module 112 further includes two fittings 164 each of which includes a seal flange 166 which engages with an aperture (not shown) in the manifold portion of housing 280 of control assembly 402. When low-airloss module 112 is positioned in housing 280, pressurized air within the housing 280 is indicated through fittings 164 to the remainder of low-airloss control module 112. In one instance, fitting 164 engages an outlet 162 which engages a fitting 144 of manifold 136. Pressurized air from housing 280 flows through fitting 164, outlet 162, and fitting 144 into manifold 136. In a second instance, a fitting 164 engages a fitting 222 of a conduit 218. Conduit 218 further includes a second fitting 220 which engages a port on manifold 136 to provide a second flow path for pressurized air from housing 280 to manifold 136 through fitting 164 and conduit 218.

Figure 20:
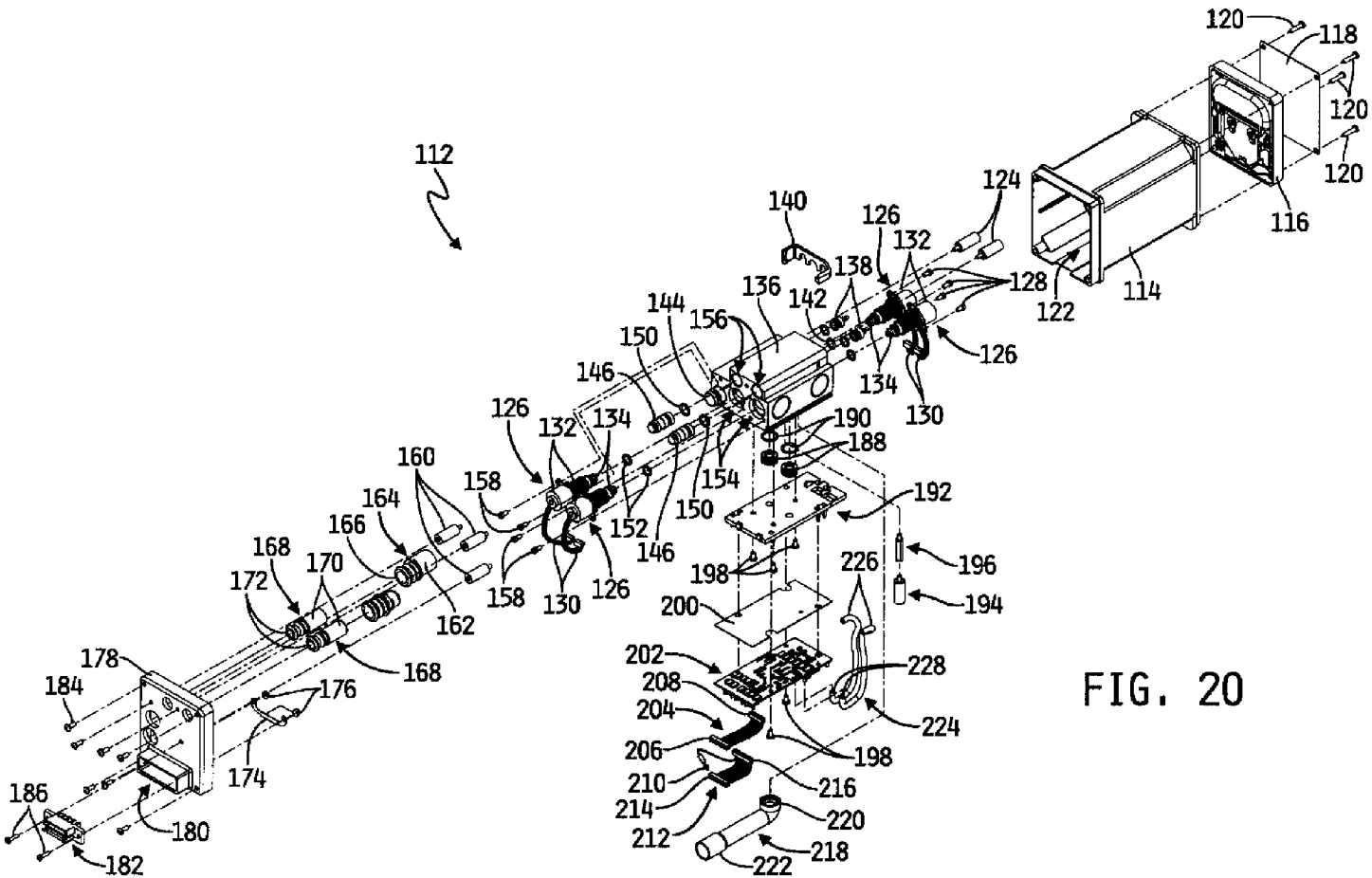
FIG. 20 is an exploded assembly view of the modular therapy device of FIG. 18.

Valve assemblies 126 are received into four ports 154 of manifold 136. Referring now to FIG. 20, valve assemblies 126 are positioned in pairs on opposite ends of manifold 136 with the ports 154, 154 adjacent the head end 50 of manifold 136 not shown. Valve assemblies 126 include a motor 132, a valve body 134, and a wire harness 130. A seal 152 is positioned in each port 154 to be interposed between valve body 134 and manifold 136 to form a pneumatic seal therebetween. Each valve assembly 126 is secured to manifold 136 through a pair of fasteners 158 which are threaded into the body of manifold 136 to secure the valve assemblies 126 thereto. Valve assemblies 126 are proportional-type pneumatic valves which are controlled to vary in the size of the flow path through manifold 136 thereby control the flow of air to the coverlet 28.

The operation of low-airloss control module 112 is dependent upon the pressure sensed in manifold 136. A pair of sensor fittings 138, 138 are secured to manifold 136 and in fluid communication with ports 156, 156 to communicate the pressure at ports 156 to a pair of sensors 230 coupled to a circuit board assembly 202. The fittings 138 are received into ports (not shown) in manifold 136 with a seal 142 interposed between the fittings 138 and manifold 136 to form a pneumatic seal. Control module 112 includes a pair of sensor tubes 224 each of which has a pressure end 226 which is engaged with a fitting 138. Sensor tubes 224 each include a sensor end 228 which engages one of the two sensors 230 to provide a fluid communication path between the sensor 230 and the fitting 138. Thereby, sensors 230 are operable to sense a pressure indicative of the pressure in respective ones of the ports 156 with the sensed pressure being used to control operation of low-airloss control module 112.

Two bladder plugs 188 are coupled to manifold 136 to plug cross-drillings of the manifold 136. A seal 190, embodied as an o-ring is interposed between each of the bladder plugs 188 and manifold 136 to provide a pneumatic seal. The tray 192 is secured to manifold 136 by three fasteners 138 with tray 192 acting as a mount for circuit board assembly 202. An insulator 200 is interposed between tray 192 and circuit board recently 202. Insulator 200 is illustratively embodied as a Mylar sheet which is positioned to prevent inadvertent electrical connections between components on circuit board assembly 202 and any conductors. A first wire harness 204 is coupled to circuit board assembly 202 through a connector 208. A second wire harness 212 is coupled to circuit board assembly 202 through a connector 216. Wire harness 212 further includes a ground strap 210. Each of the wire harnesses 130 from each of the valve assemblies 126 is coupled to circuit or somebody 202 and a specific location such that the circuitry of circuit board assembly 202 knows by position the functionality of the particular valve assembly 126. Each of the wire harnesses 204 and 212 is coupled to a connector 182 through connectors 206 and 214 respectively, with connector 182 positioned to engage an electrical connection (not shown) coupled to housing 280 of control assembly 402.

Circuit board assembly 202 is secured to tray 192 through a pair of fasteners 198. Connector 182 is secured to a cover 178 of low-airloss control module 112. A grounding plate 174 is also secured to connector 182 through the interaction of a pair of fasteners 186 which are secured by nuts 176. A retention clip 140 retains fittings 138 to manifold 136 through a snap-fit of protrusions on retaining clip 140 into slots on manifold 136. Once all components are secured to manifold 136, the subassemblies are received into a space 122 of a housing 114 of low-airloss control module 112. A cover 116 is secured opposite cover 178 with both covers being secured by fasteners, cover 178 secured by fasteners 184 and cover 116 secured by fasteners 120. Three rubber standoffs 160 are secured the cover 178 by fasteners 184 and engage manifold 136 to provide vibration dampening between manifold 136 and cover 178. Two rubber mounts 124 engage manifold 136 and cover 116 to provide vibration dampening therebetween. Similarly, a standoff 196 is engaged with a lower surface of manifold one or 36 and 80 roller mount 194 engages standoff 196 and tray 192 to provide vibration dampening between tray 192 and manifold 136.

The flow of air through low-airloss control module 112 is controlled by the operation of valve assemblies 126 to vary the flow through coverlet 28. In some instances, the pressure in housing 280 may be negative to provide a negative pressure to a various other portions of mattress 24, to deflate certain air bladders or structures, for example. Low-airloss control module 112 is configured to close off the flow of negative pressure to the coverlet 28 if necessary. It should be noted that when low-airloss control module 112 is inactive, coverlet 28 functions as a standard mattress cover. Therefore, mattress 24 is functional when the low-airloss therapy is not active.

Figure 19A:
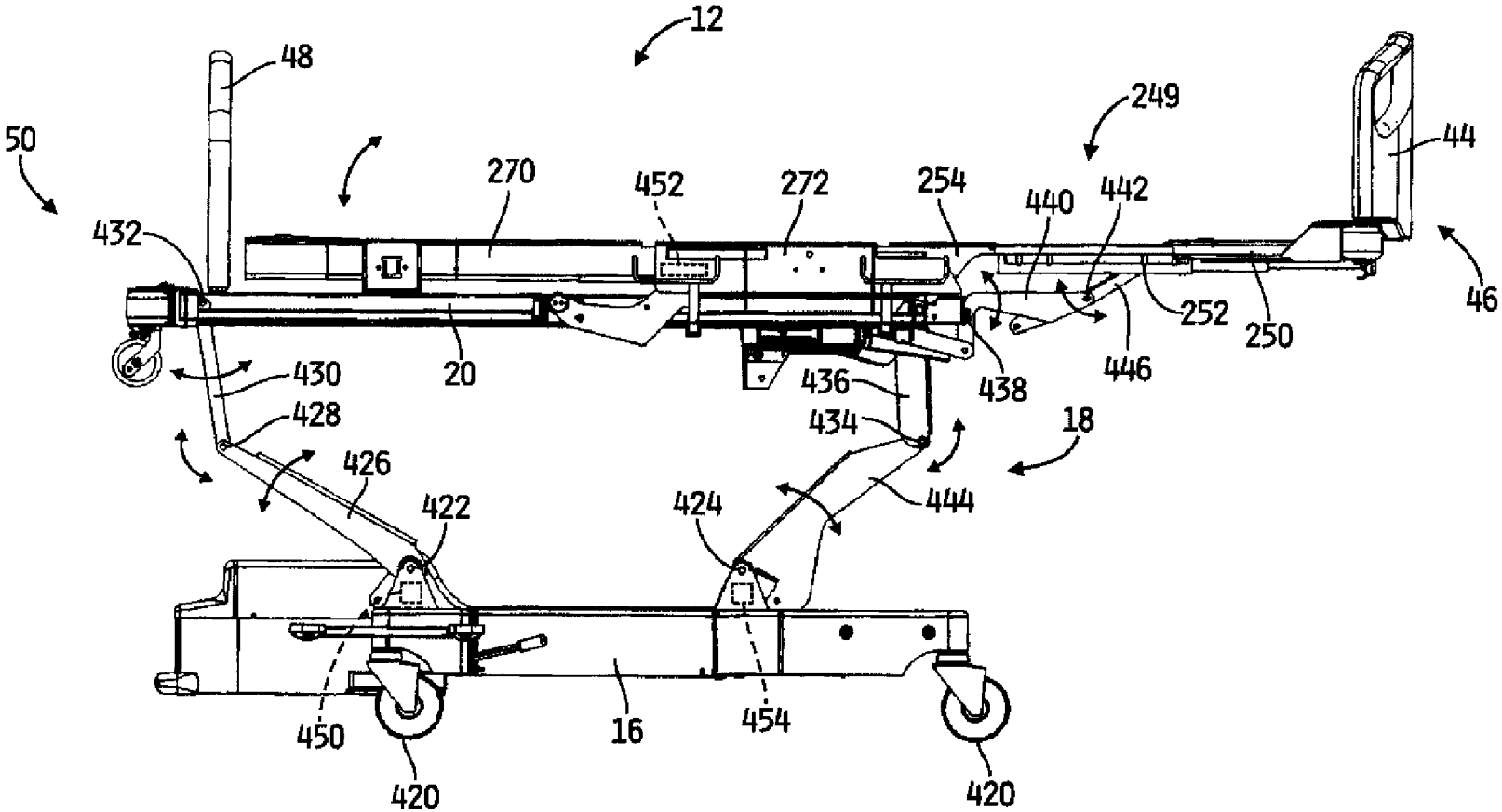
FIG. 19A is a side view of a frame of the patient-support apparatus of FIG. 1, the patient-support apparatus in a an elevated position.
Figure 19B:
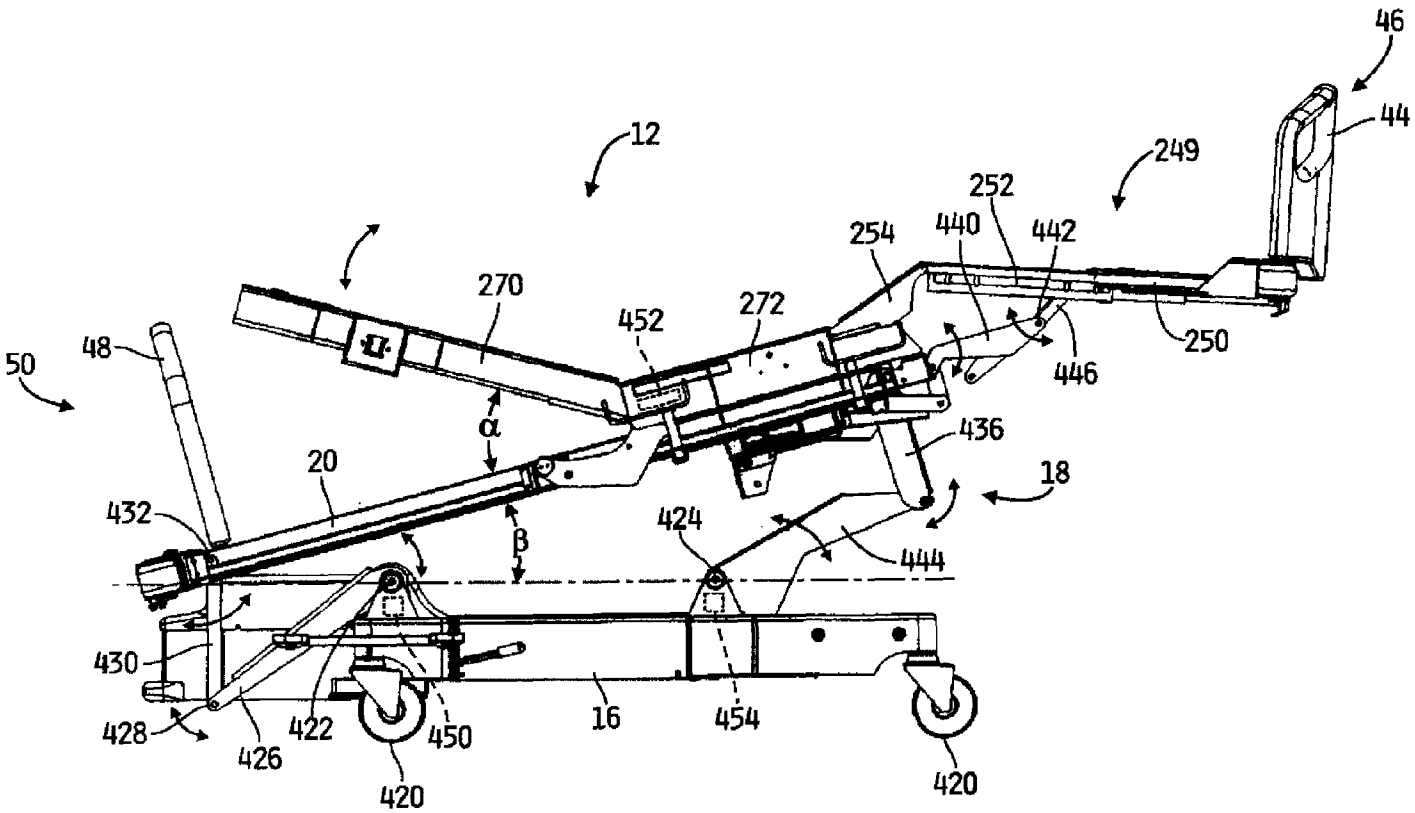
FIG. 19B is a side view of similar to FIG. 19A, the frame of the patient-support apparatus in a reclined configuration with a head section of the patient-support apparatus raised.

In addition to the various therapies described above, hospital bed 10 of the illustrative embodiment includes additional functionality particularly applicable to large or obese patients. The frame 12 is configured to articulate in a manner which increases the comfort of a large patient during articulation of head deck section 270 relative to seat deck section 272. Referring to FIGS. 19A and 19B, the articulation of structures of the frame 12 is illustrated. In a typical configuration, upper frame 20 is elevated relative to base 16. Base 16 is supported on four casters 420 which are sized to support the weight of a bariatric patient. In the illustrative embodiment, lift system 18 comprises a series of links which articulate to raise and lower the upper frame 20. A first drive link 426 is pivotably coupled to base 16 and pivotable about an axis 422. A follower link 428 is pivotably coupled to drive link 426 and pivotable relative to first drive link 426 about an axis 428. Follower link 428 is pivotably coupled to upper frame 20 and pivots relative to upper frame 20 about an axis 432. The pivoting of drive link 426 relative to base 16 is measured by a potentiometer 450 such that the power control module 412 (seen in FIG. 18) is able to discern the degree of pivoting of drive link 426 relative to base 16.

A second drive link 444 oriented near the foot end 46 of base 16 is pivotably coupled to base 16 and pivotable about an axis 424. A member 436 is coupled to upper frame 20 and extends vertically downward therefrom. The member 436 is pivotably coupled to second drive link 444 and is pivotable relative to second drive link 444 about an axis 434. Pivoting of second drive link 444 relative to base 16 is measured by a second potentiometer 454 with the information fed to power control module 412 such that power control module 412 discerns the degree of pivoting of second drive link 444 relative to base 16.

As shown in FIG. 19B, variation in the articulation of first drive link 426 about axis 422 and second drive link 444 about axis 424, results in deviation of the attitude of upper frame 20 relative to base 16. The deviation in attitude is depicted by an angle β. The tilt condition shown in FIG. 19B is sometimes referred to as forward tilt or Trendelenburg. In the illustrative embodiment, upper frame 20 is moveable between positions in which angle β varies from (−15°) to (+15°).

In the illustrative embodiment, the first drive link 426 and the second drive link 444 are each independently driven by separate hydraulic actuators (not shown). An illustrative discussion of an applicable hydraulic system is described in U.S. Pat. No. 5,715,548. It should be understood that the frame structure described herein and the hydraulic system of U.S. Pat. No. 5,715,548 are but one of many approaches to automatically driving an upper frame of a patient-support apparatus relative to a base frame. Any of a number of systems known in the art could be used in place of the illustrative lift system described herein. The use of potentiometers 450 and 454 is illustrative in nature, but should not be considered limiting of the scope of this disclosure. Other methods of measuring the degree of attitude variation of the upper frame relative to the base may be employed as well.

As discussed above, foot deck section 249 includes a moving portion 250 and a fixed portion 252. In addition, foot deck section 249 is pivotable relative thigh deck section 254. A link 440 is pivotably coupled to upper frame 20 and pivotable about an axis 438. Link 440 is pivotably coupled to a foot support link 446 which supports foot deck section 249 and is pivotable relative to link 440 about an axis 442. When link 440 is driven to pivot about axis 438, foot deck section 249 is thereby driven to pivot relative to thigh deck section 254 about an axis 266 (seen in FIG. 14).

Thigh deck section 254 is pivotably coupled to seat deck section 272 pivotable about an axis 256. Thigh deck section 254 is driven by a hydraulic cylinder (not shown) coupled to the upper frame 20. Seat deck section 272 is supported on upper frame 20. Head deck section 270 is pivotably coupled to seat deck section 272 and is pivotable about an axis 284 (seen in FIG. 14) as depicted by arrow 286. In the TotalCare® Bed System from Hill-Rom, the head deck section 270 pivots about a moving axis. It should be understood the approach disclosed herein is equally applicable to patient-support apparatuses in which the pivot axis is stationary. As shown in FIGS. 19A and 19B, pivoting of head deck section 270 relative to seat deck section 272 results in an elevation of head deck section 270 relative to upper frame 20 as characterized by an angle α shown in FIG. 19B. Elevation of head deck section 270 is measured by a potentiometer 452. In the illustrative embodiment, head deck section 270 is articulable to a position where angle α reaches a maximum of (+65°).

In the illustrative embodiment, the articulation of head deck section 270 is coordinated with a change in attitude of upper frame 20 relative to base 16. Activation of a head-up control input on the hospital bed 10 activates a hydraulic cylinder coupled to the upper frame 20 and the head deck section 270 to drive articulation of the head deck section 270 and thereby change angle α. During articulation of head deck section 270, drive system 18 is activated to articulate upper frame 20 relative to base 16 between the horizontal position shown in FIG. 19A and a forward tilt position such as the position shown in FIG. 19B. The power control module 412 controls the operation of lift system 18 to lower the head end 50 of upper frame 20 as the head deck section 270 raises. As angle a increases past a threshold, the power control module 412 increases angle β to a value of about (+7°). Angle a continues to increase until angle α reaches some threshold value. Illustratively, when angle α reaches a value of about (+40°), articulation of upper frame 20 has resulted in an angle β of about (+7°). Thus, while the patient's head is raised, the upper frame 20 reclines to provide a more comfortable feeling to a patient supported on the hospital bed 10.

The upper deck 22 and upper frame 20 are articulable to any of a number of positions from a flat position to a chair position. Various configurations of articulation positions of hospital bed 10 are shown in FIGS. 25-32. FIGS. 25-32 are representative of the adaptability of the upper deck 22 and upper frame 20. In the illustrative embodiment, the response of the upper frame 20 to the head deck section 270 may change depending on the configuration of the upper deck 22. Potentiometers measure the articulation of thigh deck section 254 and foot deck section 249 and provide feedback to the control system of hospital bed 10 so that appropriate movement of upper frame 20 is effected.

Articulation of the upper deck 22 and lower frame 20 is monitored by the control system of hospital bed 10 to determine which of several modes the hospital bed 10 is in to determine target pressure for the various bladder structures. The control system of the hospital bed 10 monitors the articulation positions of each of the upper frame 20, head deck section 270, and foot deck section 249 to determine which mode the pneumatic supply and control system 26 should be operating in to manage pressures in the various bladder structures of mattress 24. The position of each of the deck sections 270 and 249 as well as the upper frame 20 are considered in determining which mode should be active.

For example, when the foot deck section 249 is articulated less than (70°) downwardly from horizontal the mattress 24 and no other structures are articulated, the mattress 24 is operated in a NORMAL mode. If the sum of the articulation angle of the head deck section 270 and foot deck section 249 minus the articulation angle of upper frame 20 is greater than (65°) and the foot deck section 249 articulation angle is less than or equal to (30°), the mode is changed to an CHAIR mode. CHAIR mode is also activated if the articulation angle of the head deck section 270 and foot deck section 249 minus the articulation angle of upper frame 20 is greater than (75°) and the foot deck section 249 articulation angle is less than (30°). The hospital bed 10 includes a chair position user input. CHAIR mode may be activated when the chair position user input is activated as well.

In CHAIR mode, the working cushions 94 and 95 are deflated to cause a patient supported on the hospital bed 10 to be cradled by lowering the height of mattress 24. This reduces the potential for a patient to feel that they are being pushed out of the hospital bed 10 as the bed articulates to a chair position. Also, the lowering of the height of mattress 24 through cradling tends to reduce the potential for a patient to slide down toward the foot end 46 of the hospital bed 10. In some instances, the seat structure 93 may be inflated to a higher pressure during chair mode to reduce the potential for a patient to displace the structure and rest on underlying structure without an inflated interface. This situation is known as "bottoming out" and increases the potential for skin injury to a patient due to the lack of a therapeutic effect of the inflatable structures.

An OUT-OF-CHAIR mode is activated when the articulation angle of the head deck section 270 and foot deck section 249 minus the articulation angle of upper frame 20 is greater than (60°) and the foot deck section 249 articulation angle is less than (30°). OUT-OF-CHAIR mode is also activated when the articulation angle of the head deck section 270 and foot deck section 249 minus the articulation angle of upper frame 20 is less than (50°) and the foot deck section 249 articulation angle is greater than or equal to (30°). In OUT-OF-CHAIR mode, the working cushions 94 and 95 are inflated to a pressure which provides support to the remaining structures without deflection. Illustratively, working cushions 94 and 95 are maintained at a pressure which is defined by a formula in which the set point pressure is dependent the angle of articulation of head deck section 270 and patient weight. The formula is in the form of:

$$P_{working\ cushion}=K_1\times((K_2\times\text{Patient Weight})+(\text{Head Angle}\times K_3)+K_4) \quad \text{(Equation 1)}$$

In one illustrative embodiment, $K_1=0.8$; $K_2=3.0$; $K_3=6.7$; and $K_4=300.0$. Illustratively, $P_{working\ cushion}$ is limited to a minimum of 17.0 inches of water. It should be understood that while Equation 1 has been found to provide an acceptable result, any of a number of equations may be applied to determine the appropriate pressure in working cushions 94 and 95 to provide the cradle effect disclosed herein.

Although certain illustrative embodiments have been described in detail above, variations and modifications exist within the scope and spirit of this disclosure as described and as defined in the following claims.

The invention claimed is:

1. A patient-support apparatus comprising an upper frame having a head end and a foot end, the upper frame movable between a generally horizontal position and a position wherein the head end of the upper frame is spaced vertically below the foot end of the upper frame, an upper deck supported on the upper frame, the upper deck movable with the upper frame and including a seat section and a head section, the head section pivotable relative to the seat section to change the angular relationship between the head section and the seat section, a controller controlling movement of the upper frame and the head section of the upper deck such that when the head section of the upper deck moves from a first, horizontal position sensed by an angle sensor in which the head section is generally coplanar with the seat section to a second, non-horizontal position sensed by the angle sensor in which the head section is inclined, the controller causes the upper frame to move from the generally horizontal position to a first position wherein the head end of the upper frame is lowered, and wherein continued articulation of the head section upwardly to a third, non-horizontal position sensed by the angle sensor causes the controller to move the upper frame from the first position back to the generally horizontal position, and a mattress including a coverlet including (i) an entry positioned at a first end of the coverlet, (ii) an exit positioned at a second end of the coverlet opposite the entry, (iii) an upper air impermeable layer, and (iv) a lower air impermeable layer coupled to the upper layer to form an air flow path along the length of the coverlet, the flow path providing communication between the entry and the exit, wherein the upper air impermeable layer is vapor permeable and water resistant fabric, the lower air impermeable layer is vapor permeable and water resistant fabric, and the coverlet further comprises a spacer fabric interposed between the upper and lower layers to facilitate air flow through the coverlet.

2. The patient-support apparatus of claim 1, wherein the controller is in electrical communication with a peer-to-peer network of the patient-support apparatus.

3. The patient-support apparatus of claim 1, wherein the angular displacement of the upper frame is measured by at least one potentiometer.

4. The patient-support apparatus of claim 3, wherein the angular position of the head section is measured by at least one potentiometer.

5. The patient-support apparatus of claim 1, wherein the patient-support apparatus further comprises at least one inflatable structure positioned on the seat section and configured to support a portion of a patient, and wherein articulation of the head section causes the inflatable structure to deflate.

6. The patient-support apparatus of claim 5, wherein the inflatable structure continues to deflate as the head section articulates through a full range of motion of the head section.

7. The patient-support apparatus of claim 6, wherein the angular position of the head section is measured by at least one potentiometer.

8. The patient-support apparatus of claim 7, wherein the controller is in electrical communication with a peer-to-peer network of the patient-support apparatus.

9. The patient-support apparatus of claim 8, wherein the upper frame deviates from the generally horizontal position to a position wherein the upper frame is positioned at a maximum angle of about 7° below the generally horizontal position.

10. The patient-support apparatus of claim 9, wherein the head deck section is movable to an inclined angle of about 65° relative to the upper frame.

11. The patient-support apparatus of claim 1, wherein the upper frame deviates from the generally horizontal position to a position wherein the upper frame is position at a maximum angle of about 7° below the generally horizontal position.

12. The patient-support apparatus of claim 11, wherein the head deck section is movable to an inclined angle of about 65° relative to the upper frame.

13. The patient-support apparatus of claim 1, wherein the patient-support apparatus further comprises a first inflatable structure positioned on the seat section and a second inflatable structure supported on the first inflatable structure, and wherein the first inflatable structure deflates as the head section is inclined.

14. The patient-support apparatus of claim 13, wherein the second inflatable structure maintains a level of inflation during movement of the head section.

15. The patient-support apparatus of claim 14, wherein the first inflatable structure is configured to deflate to facilitate rotation of a patient supported on the patient-support apparatus.

16. The patient-support apparatus of claim 15, wherein rotation of the patient is part of continuous lateral rotation therapy.

17. The patient-support apparatus of claim 1, wherein the patient-support apparatus further comprises (i) a control system including a peer-to-peer network and (ii) a pneumatic supply and control system coupled to the peer-to-peer network, the pneumatic supply and control system configured to control operation of the coverlet.

18. The patient-support apparatus of claim 17, wherein the patient-support apparatus further comprises a control module configured to be removably coupled to the pneumatic supply and control system to control the operation of the coverlet.

19. A patient-support apparatus comprising an upper frame having a head end and a foot end, the upper frame movable between a generally horizontal position and a position wherein the head end of the upper frame is spaced vertically below the foot end of the upper frame, an upper deck supported on the upper frame, the upper deck movable with the upper frame and including a seat section and a head section, the head section pivotable relative to the seat section to change the angular relationship between the head section and the seat section, a mattress including a coverlet including (i) an entry positioned at a first end of the coverlet, (ii) an exit positioned at a second end of the coverlet opposite the entry, (iii) an upper air impermeable layer, and (iv) a lower air impermeable layer coupled to the upper layer to form an air flow path along the length of the coverlet, the flow path providing communication between the entry and the exit, a control system including a peer-to-peer network and a controller controlling movement of the upper frame and the head section of the upper deck such that when the head section of the upper deck moves from a first, horizontal position sensed by an angle sensor in which the head section is generally coplanar with the seat section to a second, non-horizontal position sensed by the angle sensor in which the head section is inclined, the controller causes the upper frame to move from the generally horizontal position to a first position wherein the head end of the upper frame is lowered, and wherein continued articulation of the head section upwardly to a third, non-horizontal position sensed by the angle sensor causes the controller to move the upper frame from the first position back to the generally horizontal position, a pneumatic supply and control system coupled to the peer-to-peer network, and a control module configured to be removably coupled to the pneumatic supply and control system to control the operation of the coverlet, the control module including (i) a controller communicating with the pneumatic supply and control system, (ii) a plurality of connectors configured to engage the pneumatic supply and control system to receive pressurized air, (iii) an electrical connector configured to engage the pneumatic supply and control system to provide electrical communication between the controller and the pneumatic supply and control system, (iv) a plurality of outputs configured to provide pneumatic communication between the control module and the coverlet, and (v) a plurality of valves responsive to the controller to control a flow of pressurized air from the pneumatic supply and control system to the coverlet.

20. The patient-support apparatus of claim 19, wherein the upper air impermeable layer is vapor permeable and water resistant fabric, the lower air impermeable layer is vapor permeable and water resistant fabric, and the coverlet further comprises a spacer fabric interposed between the upper and lower layers to facilitate air flow through the coverlet.

21. The patient-support apparatus of claim 19, wherein the coverlet is removably coupled to the mattress.

22. The patient-support apparatus of claim 21, wherein the mattress further comprises a first inflatable structure configured to provide continuous lateral rotation therapy, a second inflatable structure supported on the first inflatable structure, and a third inflatable structure supported on the second inflatable structure the third inflatable structure including a plurality of air chambers which may be selectively and alternatively rapidly inflated to provide percussion and vibration therapy to a patient supported on the patient-support apparatus.

23. A patient-support apparatus comprising an upper frame having a head end and a foot end, the upper frame movable between a generally horizontal position and a position wherein the head end of the upper frame is spaced vertically below the foot end of the upper frame, an upper deck supported on the upper frame, the upper deck movable with the upper frame and including a seat section and a head section, the head section pivotable relative to the seat section to change the angular relationship between the head section and the seat section, and a controller controlling movement of the upper frame and the head section of the upper deck such that when the head section of the upper deck moves from a first, horizontal position sensed by an angle sensor in which the head section is generally coplanar with the seat section to a second, non-horizontal position sensed by the angle sensor in which the head section is inclined, the controller causes the upper frame to move from the generally horizontal position to a first position wherein the head end of the upper frame is lowered, and wherein continued articulation of the head section upwardly to a third, non-horizontal position sensed by the angle sensor causes the controller to move the upper frame from the first position back to the generally horizontal position.

* * * * *